US006318349B1

(12) United States Patent
Muto et al.

(10) Patent No.: US 6,318,349 B1
(45) Date of Patent: Nov. 20, 2001

(54) AIR-FUEL RATIO CONTROL APPARATUS OF INTERNAL COMBUSTION ENGINE AND CONTROL METHOD FOR THE SAME

(75) Inventors: Harufumi Muto; Makoto Fujita, both of Nishikamo-gun; Naoto Kushi, Okazaki, all of (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/560,298

(22) Filed: Apr. 27, 2000

(30) Foreign Application Priority Data

May 21, 1999 (JP) ..... 11-142038

(51) Int. Cl.[7] ..... F02D 41/00
(52) U.S. Cl. ..... 123/674; 123/698
(58) Field of Search ..... 123/674, 675, 123/698

(56) References Cited

U.S. PATENT DOCUMENTS 5,704,339 * 1/1998 Choe et al. ..... 123/674
5,921,226 * 7/1999 Toyahara et al. ..... 123/674
6,161,530 * 12/2000 Kakizaki et al. ..... 123/674
6,173,703 * 1/2001 Matsumoto ..... 123/698
6,227,033 * 5/2001 Kainz ..... 123/674
6,230,699 * 5/2001 Mitsutani ..... 123/674
6,237,580 * 5/2001 DeGroot et al. ..... 123/698

FOREIGN PATENT DOCUMENTS

10220307 A 8/1998 (JP) .

* cited by examiner

*Primary Examiner*—John Kwon
(74) *Attorney, Agent, or Firm*—Oliff & Berridge, PLC.

(57) ABSTRACT

An air-fuel ratio control apparatus of an internal combustion engine is provided which enables highly accurate calibration of an air-fuel feedback correction value to be completed in a short time, thus avoiding adverse influences on the emissions. The engine load is fixed when the air-fuel ratio or purge concentration is calibrated from the behavior of the air-fuel ratio feedback correction value. Thus, no change is observed in the engine load even if the driver operates the accelerator pedal to adjust the accelerator pedal position so as to change the required torque, and the air-fuel ratio of the air-fuel mixture is stabilized. Accordingly, air-fuel ratio calibration or purge concentration calibration can be promptly accomplished with high accuracy. Furthermore, while the engine load is being adjusted, the output torque is controlled in accordance with the required torque by adjusting the ignition timing. Thus, the required torque can be sufficiently reflected by the output torque even when calibration is carried out with the engine load fixed.

26 Claims, 19 Drawing Sheets

AIR-FUEL RATIO CONTROL APPARATUS OF INTERNAL COMBUSTION ENGINE AND CONTROL METHOD FOR THE SAME

INCORPORATION BY REFERENCE

The disclosure of Japanese Patent Application No. HEI 11-142038 filed on May 21, 1999 including the specification, drawings and abstract is incorporated herein by reference in its entirety.

BACKGROUND OF THE INVENTION

1. Field of Invention

The present invention relates to an air-fuel ratio control apparatus of an internal combustion engine and control method for the same. In particular, this invention relates to such an apparatus that controls the fuel concentration of an air-fuel mixture in a feedback manner, based on an air-fuel ratio feedback correction value calculated based on the air-fuel ratio of the air-fuel mixture, and an air-fuel ratio calibration value that is sensed from the behavior of the air-fuel ratio feedback correction value, so that the air-fuel mixture is maintained at a target air-fuel ratio.

2. Description of Related Art

A technique for controlling the air-fuel ratio of an air-fuel mixture of the engine to the stoichiometric air-fuel ratio is known for the purpose of purifying the emissions or exhaust gases of the engine using catalytic converters. In this technique, a sensor (e.g., an oxygen sensor) capable of detecting a physical quantity representing the air-fuel ratio is located in an exhaust passage of the engine, and an air-fuel ratio feedback correction value is determined based upon the detected air-fuel ratio. An amount of fuel to be supplied is then calculated based on the air-fuel ratio feedback correction value and the intake air flow rate. Thus, the air-fuel ratio can be controlled by increasing/decreasing the amount of fuel supplied in accordance with the intake air flow rate, depending upon the air-fuel ratio feedback correction value.

In the air-fuel ratio feedback control as described above, "deviations" appear in the air-fuel ratio feedback correction values because of differences among individual engines or individual sensors, or chronological changes, for example. These "deviations" may cause reduction in the accuracy with which the air-fuel ratio is controlled upon transition of the engine from one operating state to another. To overcome this problem, such a deviation that appears in an air-fuel ratio feedback correction value is stored in a memory, for example, and kept as an air-fuel ratio calibration value, which is used along with the air-fuel ratio feedback correction value for controlling the fuel concentration of the air-fuel mixture (as disclosed in, for example, Japanese Patent Laid-open Publication No. HEI 10-220307).

The air-fuel ratio calibration value is input from the behavior of the air-fuel ratio feedback correction value. For example, the air-fuel ratio calibration value is calculated by addition or subtraction, from the positional relationship between the average value of the air-fuel ratio feedback correction values and a specified range, so that the average value falls within the specified range. When the load to the engine varies, the intake air flow rate fluctuates, and the air-fuel ratio changes relative to the target air-fuel ratio. Accordingly, an error is likely to arise in the air-fuel ratio calibration value if air-fuel ratio calibration is performed in this case.

The overall range of the engine load may be divided into a plurality of calibration regions, and an air-fuel ratio calibration value may be obtained for each load region. However, if the engine load fluctuates too rapidly between two calibration regions, an adequate time period may not be available for air-fuel ratio calibration in each load region. Consequently, the air-fuel ratio calibration value may not be obtained, or it may take an undesirably long time until the calibration value is obtained.

If an error occurs in the air-fuel ratio calibration value as described above, the air-fuel ratio control is inaccurately performed during transition of the engine from one operating state to another. Also, if the air-fuel ratio calibration value is not obtained for a long period of time, the air-fuel ratio control during this period is inaccurately performed, resulting in deterioration of the quality of the emissions.

With a vaporized fuel purge system for purging fuel that vaporizes from a fuel tank of the engine into an intake pipe is provided in the engine, the purge concentration needs to be calibrated to the amount of fuel to be supplied, so that the air-fuel ratio can be controlled with high degree of accuracy. However, if the air-fuel ratio calibration value involves an error, as described above, an error also arises in purge concentration reducing the accuracy of control the air-fuel ratio during transition from one operating state of the engine to another. Also, where calculation of the air-fuel ratio calibration value is delayed, purge concentration calibration cannot be started, and the air-fuel ratio is inaccurately controlled, resulting in further deterioration in the quality of the emissions.

SUMMARY OF THE INVENTION

It is an object of the present invention to achieve highly accurate calibration of an air-fuel ratio feedback correction value efficiently, and thereby avoid adverse influences on the emissions.

To accomplish the above-described object, the present invention provides an air-fuel ratio control apparatus of an internal combustion engine, which includes a detector that detects the air-fuel ratio of an air-fuel mixture supplied to the engine, and a control system. The control system is adapted to determine an air-fuel ratio feedback correction value based on the air-fuel ratio, and regulates an air-fuel ratio calibration value from the behavior of the air-fuel ratio feedback correction value. The control system then controls the air-fuel mixture, based on the air-fuel ratio feedback correction value and the air-fuel ratio calibration value. The control system initially sets the engine load to a fixed value, while it is reading the air-fuel ratio calibration value.

With the engine load fixed as deserted above, the air-fuel ratio of the air-fuel mixture is reset, which allows calibration of the air-fuel ratio feedback correction value accurately and promptly.

Accordingly, highly accurate calibration of the air-fuel ratio feedback correction value can be completed in an early stage of control, and therefore adverse influences on the emissions can be prevented.

Even while the engine load is being fixed as described above, the output torque of the engine may be controlled by adjusting one or more engine output torque variation factor (s).

DETAILED DESCRIPTION OF PREFERRED EMBODIMENTS

A preferred embodiment of the present invention will be described with reference to the accompanying drawings.

Figure 1:
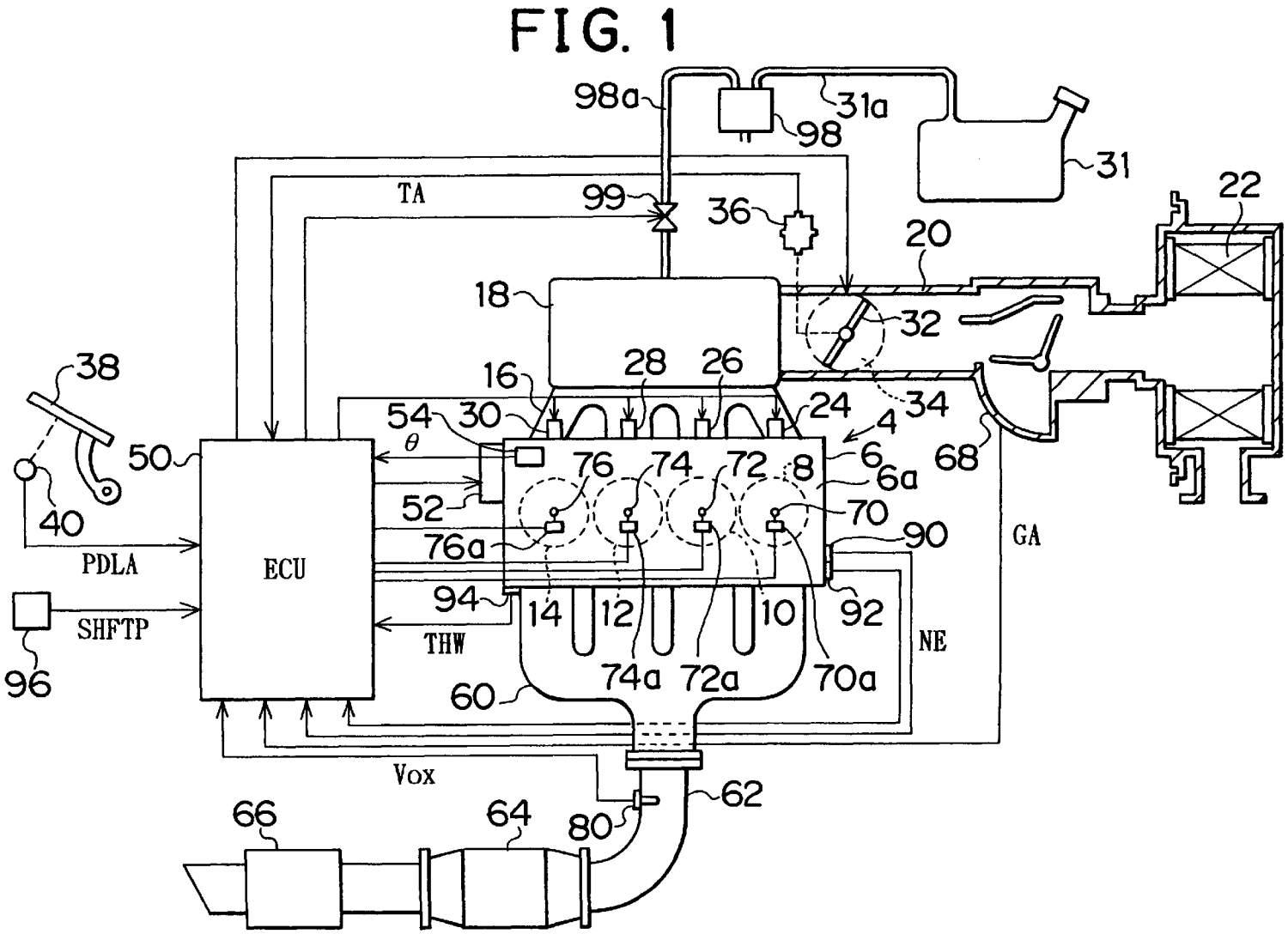
FIG. 1 is a block diagram schematically showing the construction of a gasoline engine and its control system according to one embodiment of the present invention.

FIG. 1 is a block diagram schematically showing the construction of a gasoline engine (which will be simply called "engine") 4 that is mounted in an automobile for running the automobile, and its control system.

The engine 4 includes a cylinder block 6 having first cylinder 8, second cylinder 10 third cylinder 12 and fourth cylinder 14. An intake passage 20 is connected to each of the cylinders 8, 10, 12, 14, via an intake manifold 16 and a surge tank 18. An air cleaner 22 is provided on the upstream side of the intake passage 20, and ambient air is introduced into the intake passage 20 through the air cleaner 22.

Fuel injectors 24, 26, 28, 30, corresponding to the respective cylinders 8, 10, 12, 14, are provided in the intake manifold 16. The injectors 24, 26, 28, 30, are solenoid operated valves that are driven to be opened or closed with controlled current applied thereto, and serve to jet or eject fuel that is carried under pressure from a fuel tank 31 by means of a fuel pump (not shown). The fuel ejected from the injectors 24, 26, 28, 30 is mixed with intake air in the intake manifold 16, to provide an air-fuel mixture. The air-fuel mixture is introduced into a combustion chamber of each of the cylinders 8, 10, 12, 14, through a corresponding intake port (not shown) that is opened when an intake valve (not shown) provided for each cylinder 8, 10, 12, 14, is opened. Under air-fuel ratio feedback control which will be described later, the length of fuel injection time (duration of fuel injection) of the injectors 24, 26, 28, 30, is controlled based on an air-fuel ratio feedback correction factor, FAF (which is equivalent to an air-fuel ratio feedback correction value), an air-fuel ratio calibration value KG, and so forth.

A throttle valve 32, for adjusting the intake air flow rate or the specific volume of intake air, is provided in the intake passage 20 to be located upstream of the surge tank 18. The throttle valve 32 is driven (opened and closed) by a throttle motor 34 provided in the intake passage 20, so that its opening, or throttle opening, TA, is adjusted as desired. A throttle sensor 36, which is located in the vicinity of the throttle valve 32, serves to detect the throttle opening, TA, and generates a signal corresponding to the throttle opening, TA.

Also, an accelerator pedal 38 is provided in a driver compartment of the automobile, and an accelerator sensor 40 is provided for detecting the amount of depression of the accelerator pedal 38, or an accelerator pedal position, PDLA. An electronic control unit (hereinafter referred to as "ECU") 50 which will be described later, controls the throttle motor 34 based on the accelerator pedal position, PDLA and others, to adjust the throttle opening, TA, in accordance with the driving conditions. If necessary, the throttle opening, TA, is adjusted so that the engine load is fixed, as described later.

A variable valve timing device (hereinafter abbreviated to "VVT") 52 permits an intake camshaft (not shown) having intake cams that determine the lift amount of intake valves to be rotated relative to the engine crankshaft (not shown). The VVT 52 is adapted to change the valve timing of the intake valves depending upon the operating conditions of the engine 4, so as to allow adjustment of valve overlap with exhaust valves. The valve timing is obtained based on the phase θ of rotation of the intake camshaft detected by a cam angle sensor 54.

An exhaust passage 62 is connected to each of the cylinders 8, 10, 12, 14, via an exhaust manifold 60. The exhaust passage 62 is provided with a catalytic converter 64 and a muffler 66. Exhaust gas that flows through the exhaust passage 62 passes through the catalytic converter 64 and the muffler 66, and is then discharged to the outside of the vehicle.

An air flow meter 68 is provided between the air cleaner 22 and the throttle valve 32 in the intake passage 20. The air flow meter 68 detects the flow rate GA of intake air that is introduced into the combustion chamber of each cylinder 8, 10, 12, 14, and generates a signal representing the intake air flow rate GA.

A cylinder head 6*a*, of the engine 4 is provided with spark plugs 70, 72, 74, 76, corresponding to the respective cylinders 8, 10, 12, 14. The spark plugs 70, 72, 74, 76, are respectively accompanied by ignition coils 70*a*, 72*a*, 74*a*, 76*a*, to provide a direct ignition system that does not use a distributor. Each of the ignition coils 70*a*, 72*a*, 74*a*, 76*a*, operates to apply a high voltage generated upon cut-off of primary-side current supplied from an ignition drive circuit within the ECU 50, directly to the corresponding spark plugs 70, 72, 74, 76, in suitable ignition timing.

An oxygen sensor 80 is located upstream of the catalytic converter 64 within the exhaust passage 62. The oxygen sensor 80 generates a signal Vox representing the air-fuel ratio of air-fuel mixture which appears in components of exhaust. Air-fuel feedback control, as described later, is performed based on the signal Vox, so that the air-fuel ratio is controlled to the stoichiometric air-fuel ratio, by suitably increasing or reducing the-amount of fuel to be injected.

An engine speed sensor 90, generates a pulse signal corresponding to the engine speed NE of the engine 4, based on the rotating speed of the crankshaft of the engine 4, and a cylinder identification sensor 92 generates a pulse signal as a reference signal for each specified crank angle during rotation of the crankshaft to identify each of the cylinders 8, 10, 12, 14. The ECU 50 calculates the engine speed, NE, and the crank angle, and also performs cylinder identification, based on the output signals from the engine speed sensor 90 and cylinder identification sensor 92.

A water temperature sensor 94, for detecting the engine coolant temperature, which is provided in the cylinder block 6, generates a signal indicative of the coolant temperature, THW. A shift position sensor 96 is provided in a transmission that is not illustrated, and operates to generate a signal indicative of the shift position, SHFTP. This transmission is a continuously variable transmission, and the shift position is controlled by the ECU 50.

Vaporized fuel that appears in the fuel tank 31 is directed to a canister 98 through a vapor pipe 31*a*. The canister 98 and the surge tank 18 are connected with each other through a purge pipe 98*a*. A purge control valve 99 is mounted in the middle of the purge pipe 98*a*. The opening of the purge control valve 99 is adjusted depending upon the operating state of the engine 4, and vaporized fuel is purged or discharged into the surge tank 18 as needed.

Figure 2:
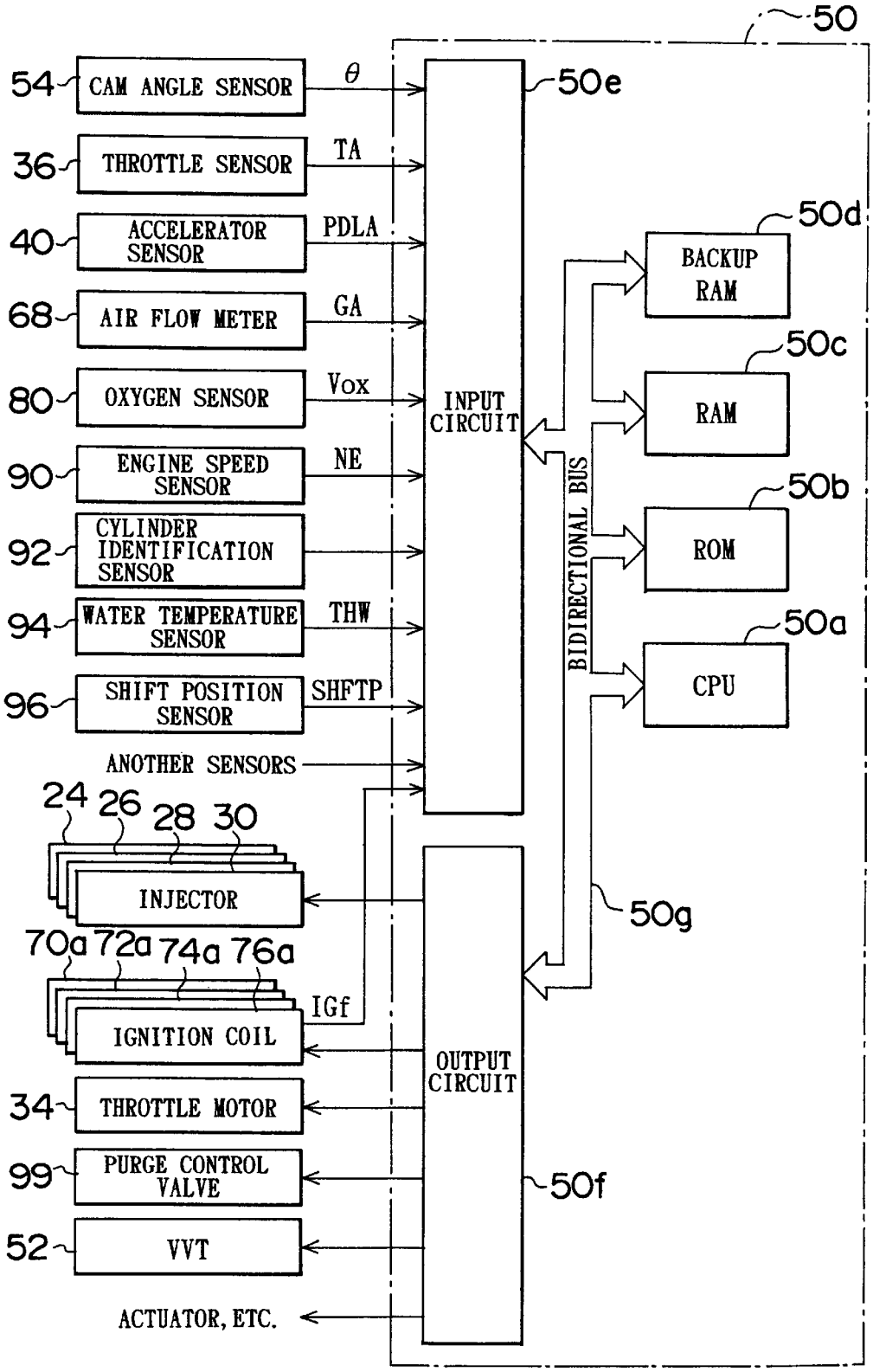
FIG. 2 is a block diagram showing the arrangement of the control system of the present invention.

Referring now to the block diagram of FIG. 2, the construction of an air-fuel ratio control apparatus of the first embodiment of the present invention and its control system will be described.

The ECU 50 includes a central processing unit (CPU) 50*a*, read only memory (ROM) 50*b*, random access memory (ROM) 50*c*, backup RAM 50*d*, and other components. The ECU 50 consists of a logic unit or circuit in which the above indicated components 50*a*–50*d* are connected to an input circuit 50*e*, an output circuit 50*f*, and others, through a bidirectional bus 50*g*. The ROM 50*b* stores therein various control programs, such as air-fuel ratio feedback control, purge control, and throttle opening control, as described later, and various types of data. The RAM 50*c* temporarily stores operation results of the CPU 50*a* obtained in various control operations, and other data.

The input circuit 50*e*, serving as an input interface, includes a buffer, waveform shaping circuit, A/D converter, and others. To the input circuit 50, are respectively connected, the throttle sensor 36, accelerator position sensor 40, cam angle sensor 54, air flow meter 68, oxygen sensor 80, engine speed sensor 90, cylinder identification sensor 92, water temperature sensor 94, shift position sensor 96, lines transmitting ignition confirmation signals IGf of the respective ignition coils 70*a*, 72*a*, 74*a*, 76*a*, and other sensors. The output signals, of the respective sensors, are converted into digital signals, which are then transmitted through the bidirectional bus 50*g* and read into the CPU 50*a*.

On the other hand, the output circuit 50*f* includes various drive circuits, and the fuel injectors 24, 26, 28, 30, VVT 52, ignition coils 70*a*, 72*a*, 74*a*, 76*a*, throttle motor 34, purge control valve 99 and other actuators, are connected to the output circuit 50*f* The ECU 50 performs arithmetic operations based on the output signals from the respective sensors, and control the above-indicated components or actuators.

For example, the ECU 50 calculates a load of the engine 4 based on the intake air flow rate, GA, detected by the air flow meter 68, and also controls the amount and timing of fuel injection performed by the injectors 24, 26, 28, 30, and the valve timing of the VVT 52, and the ignition timing of the ignition coils 70*a*, 72*a*, 74*a*, 76*a*, depending upon the engine load and the engine speed NE. The ECU 50 then corrects the amount of fuel to be injected by the injectors 24, 26, 28, 30, by increasing or reducing it, based on the air-fuel ratio detected by the oxygen sensor 80, so as to accurately control the air-fuel ratio of the air-fuel mixture. The cylinder block 6 is also provided with a knock sensor, that is not illustrated, and the ECU 50 performs knock control for appropriately controlling the ignition timing so as to prevent knocking.

Referring next to the flowcharts of FIG. 3 through FIG. 11, air-fuel ratio feedback control and its associated routines, to be executed by the ECU 50, will be now described. It is to be noted that step numbers in a flowchart corresponding to each routine are denoted by "S~".

Figure 3:
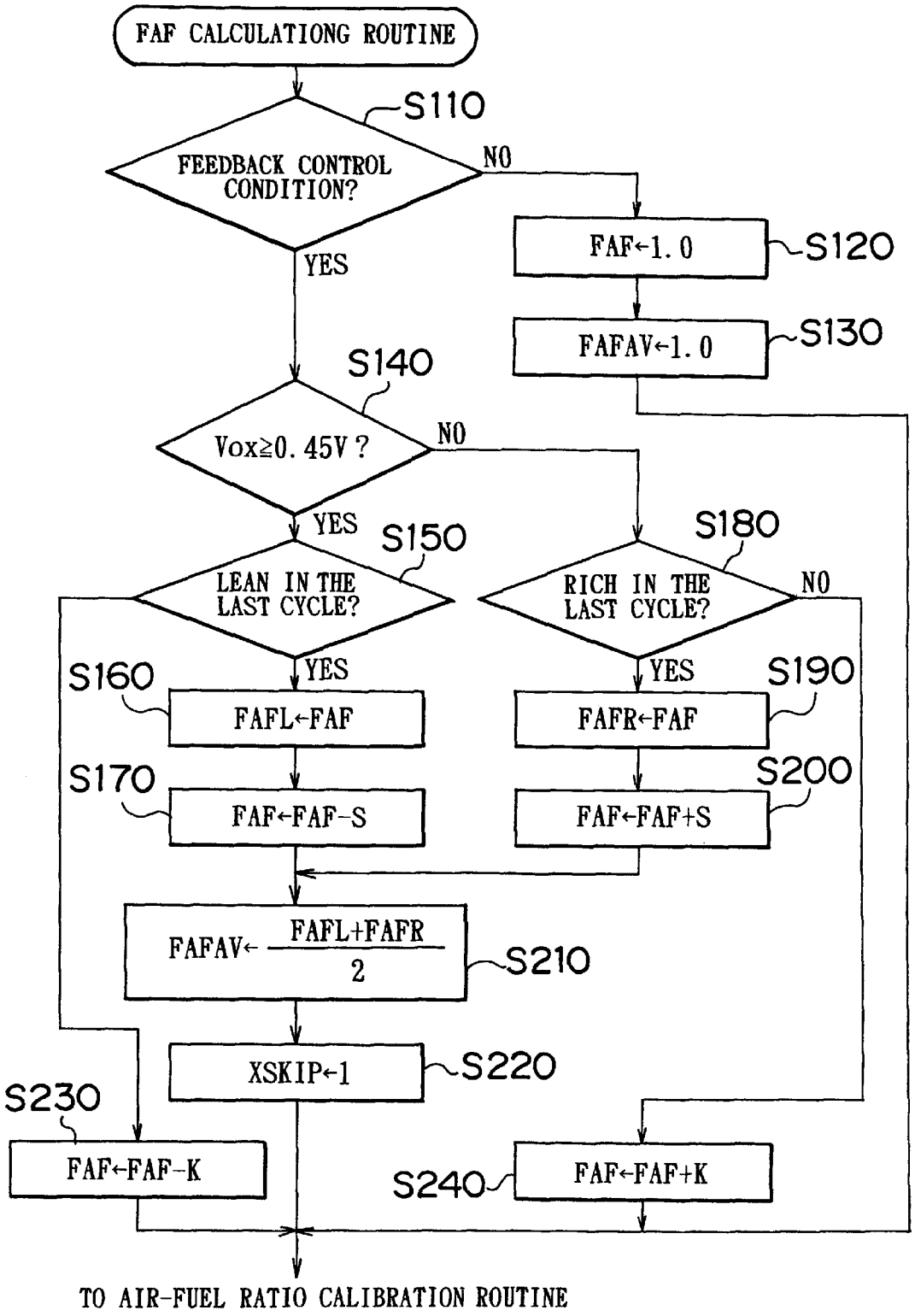
FIG. 3 is a flowchart of an air-fuel ratio feedback correction factor FAF calculating routine according to the present invention.

Initially, an air-fuel ratio feedback correction factor, FAF, calculating routine, as shown in the flowchart of FIG. 3, will be explained. This routine is repeatedly executed every set time period or interval.

Once the routine is started, step S110 is executed to determine if air-fuel ratio feedback control conditions are established. If the feedback control conditions are not established ("NO" in step S110), the air-fuel ratio feedback correction factor FAF is set to 1.0 in step S120, and the average value, FAFAV, of the air-fuel ratio feedback correction factor, FAF, is set to 1.0 in step S130.

Figure 13:
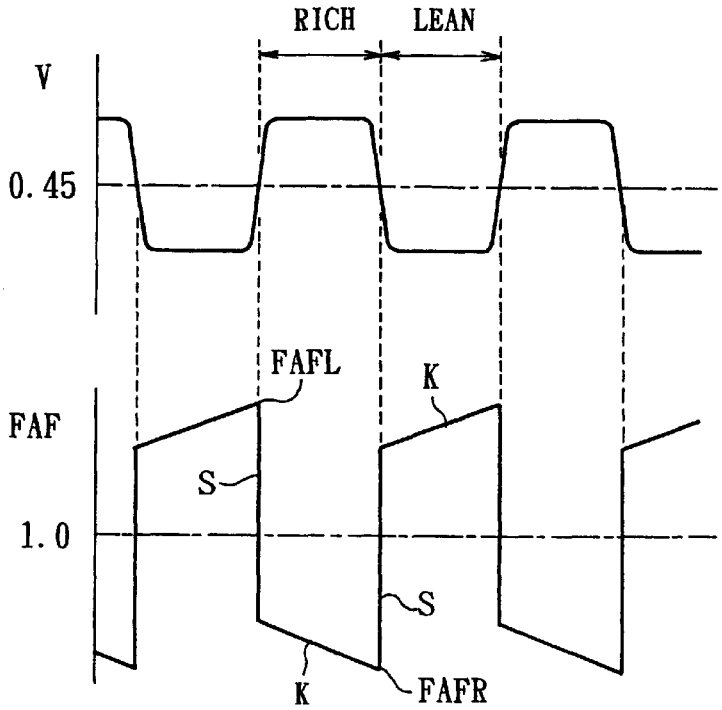
FIG. 13 is a timing chart of air-fuel ratio control of the present invention.

If the feedback control conditions are established ("YES" in step S110), step S140 is executed to determine if the output voltage Vox of the oxygen sensor 80 is greater than or equal to 0.45V, indicating if the air-fuel ratio is rich. If the output voltage Vox is greater than or equal to 0.45V ("YES" in step S140), indicating the air-fuel ratio is rich, step S150 is executed to determine if the air-fuel ratio was lean in the last cycle of the control routine. If the air-fuel ratio was lean in the last cycle ("YES" in step S150) with the air-fuel ratio changing from lean to rich, the value of the air-fuel ratio feedback correction factor, FAF, is set to a variable, FAFL, on the RAM 50*c*, in step S160. Step S170 is then executed to subtract a skip value S from the air-fuel ratio feedback correction factor, FAF. In this manner, the air-fuel ratio feedback correction factor, FAF, is reduced by the skip value S, as shown in FIG. 13.

However, if the output voltage Vox is lower than 0.45V ("NO" in step S140), indicating the air-fuel ratio is lean, step S180 is executed to determine if the air-fuel ratio was rich in the last cycle of the routine. If the air-fuel ratio was rich in the last cycle ("YES" in step S180), indicating the air-fuel ratio changed from rich to lean, the value of the feedback correction factor, FAF, is set to a variable, FAFT, on the RAM 50*c*, in step S190. Step S200 is then executed to add a skip value S to the air-fuel ratio feedback correction factor, FAF. In this manner, the air-fuel ratio feedback correction factor, FAF, is increased by the skip value S, as shown in FIG. 13.

Step S170 or step S200 is followed by step S210 in which the average value, FAFAV, of the variable FAFL, and variable FAFR is calculated according to the following expression (1).

$$FAFAV=(FAFL+FAFR)/2 \quad (1)$$

Subsequently, a skip flag XSKIP is set to 1, in step S220.

If step S150 determines that the air-fuel ratio was rich in the last control cycle ("NO" in step S150), step S230 is executed to subtract a value K from the air-fuel ratio feedback correction factor, FAF. It is to be noted that the value K is sufficiently smaller than the skip value S. Thus, the air-fuel ratio feedback correction factor, FAF, gradually decreases as shown in FIG. 13.

If the above step S180 determines that the air-fuel ratio was lean in the last control cycle ("NO" in step S180), step S240 is executed to add the value K to the air-fuel ratio feedback correction factor, FAF. Thus, the air-fuel ratio feedback correction factor, FAF, gradually increases as shown in FIG. 13.

If the air-fuel ratio becomes rich and the FAF is reduced, as described above, the fuel injection time, TAU, described later, is shortened. However, if the air-fuel ratio becomes lean and the FAF is increased, the fuel injection time, TAU, is increased. In this manner, the air-fuel ratio is maintained at a target air-fuel ratio (stoichiometric air-fuel ratio in the present embodiment).

Figure 4:
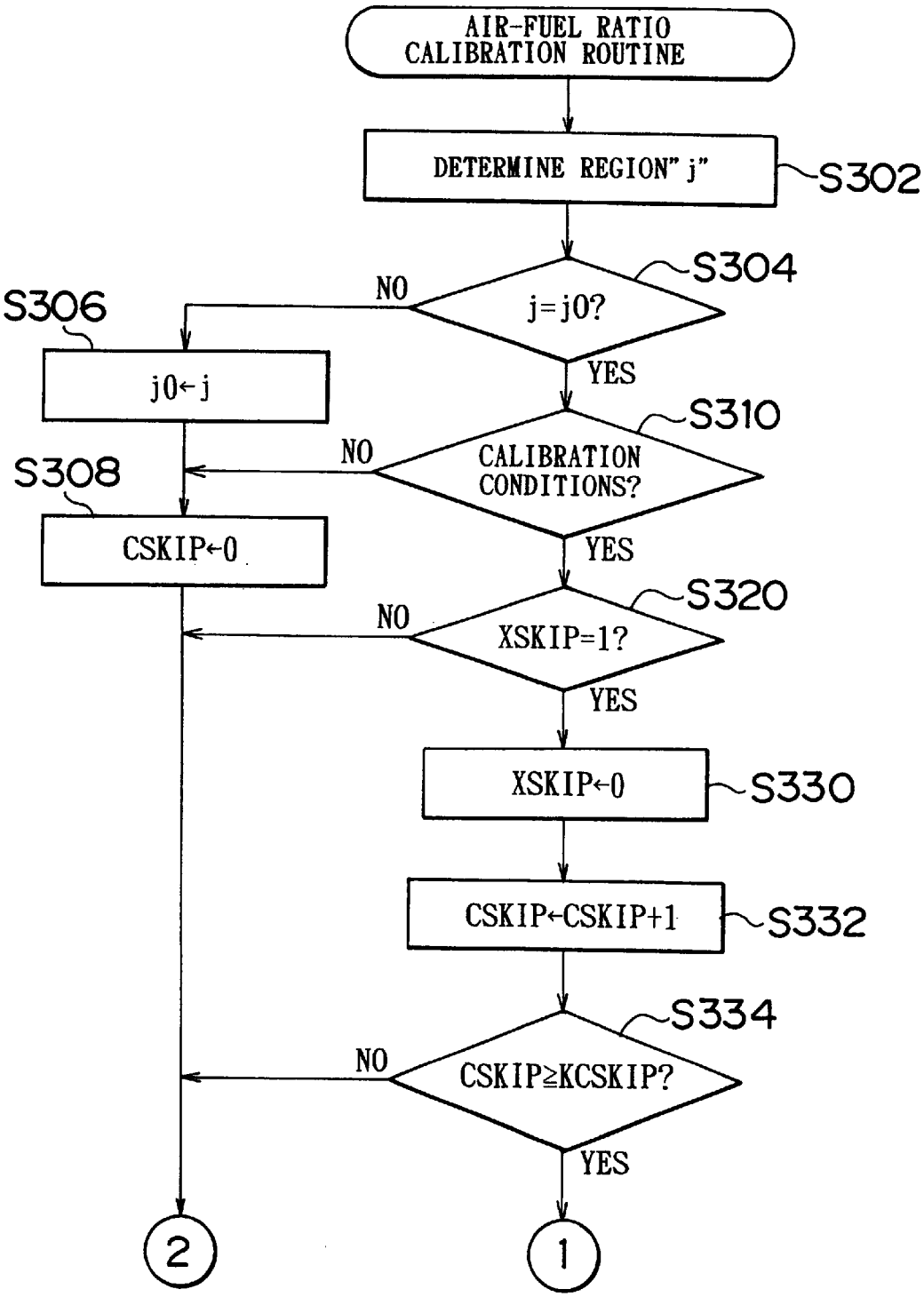
FIG. 4 is a flowchart of an air-fuel ratio calibration routine according to the present invention.
Figure 5:
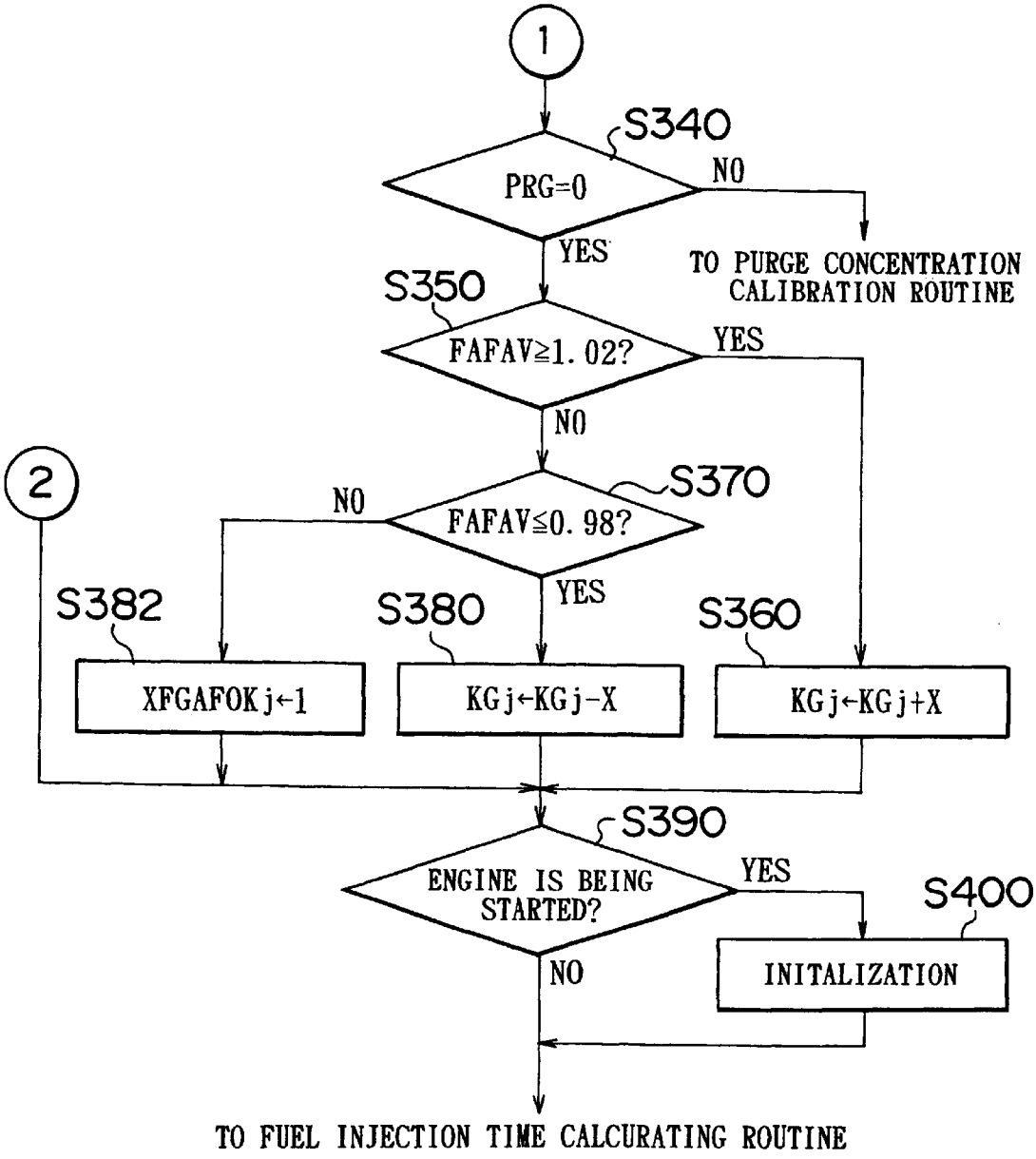
FIG. 5 is a flowchart of an air-fuel ratio calibration routine according to the present invention.

Upon the completion of step S130, step S220, step S230 or step S240, the air-fuel ratio feedback correction factor, FAF, calculating routine, as shown in FIG. 3, is terminated, and an air-fuel ratio calibration routine, as shown in the flowcharts of FIG. 4 and FIG. 5, is executed.

During the air-fuel ratio calibration routine, step S302 is initially executed to determine an air-fuel ratio calibration region "j". The air-fuel ratio calibration region "j" is selected from a plurality of calibration regions that are configured depending upon the value of the engine load. In the present embodiment, the intake air flow rate GA is used as the engine load, and four air-fuel ratio calibration regions (j=1, 2, 3, 4) are established to correspond to four sections within the range of 0% to 100% of the maximum intake air flow rate.

In the above manner, the current air-fuel ratio calibration region "j" is determined in step S302, based on the intake air flow rate, GA, detected by the air flow meter 68.

Step S304 is then executed to determine whether the current air-fuel ratio calibration region "j" is the same as the air-fuel ratio calibration region "j0" in the last cycle of the control routine. If "j" is not the same as "j0" ("NO" in step S304), indicating the air-fuel ratio calibration region is different from the one determined in the last cycle, "j" is set to "j0" in step S306, and a skip counter CSKIP is cleared in step S308.

However, if step S304 determines that "j" is the same as "j0" ("YES" in step S304), indicating the engine is kept operating in the same air-fuel ratio calibration region, step S310 is executed to determine if air-fuel ratio calibration conditions are met. If the air-fuel ratio calibration conditions are not met ("NO" in step S310), the control flow goes to step S308 as described above.

If the air-fuel ratio calibration conditions are met ("YES" in step S310), step S320 is executed to determine if a skip flag XSKIP is set. If XSKIP is equal to 1 ("YES" in step S320), the skip flag XSKIP is reset (XSKIP=0) in step S330, and the skip counter, CSKIP, is incremented in step S332.

Step S334 is then executed to determine if the value of the skip counter, CSKIP, is greater than or equal to a specified number of skips KCSKIP. If CSKIP is greater than or equal to KCSKIP (CSKIP≧KCSKIP) ("YES" in step S334), indicating skipping is repeated the specified number of times KCSKIP in the same air-fuel ratio calibration region, step S340 is then executed to determine if the purge rate, PGR, is equal to zero or not. During operation, when the purge rate, PGR, is zero, the purge control valve 99 is not opened, and fuel vapor is purged into the intake air.

Figure 6:
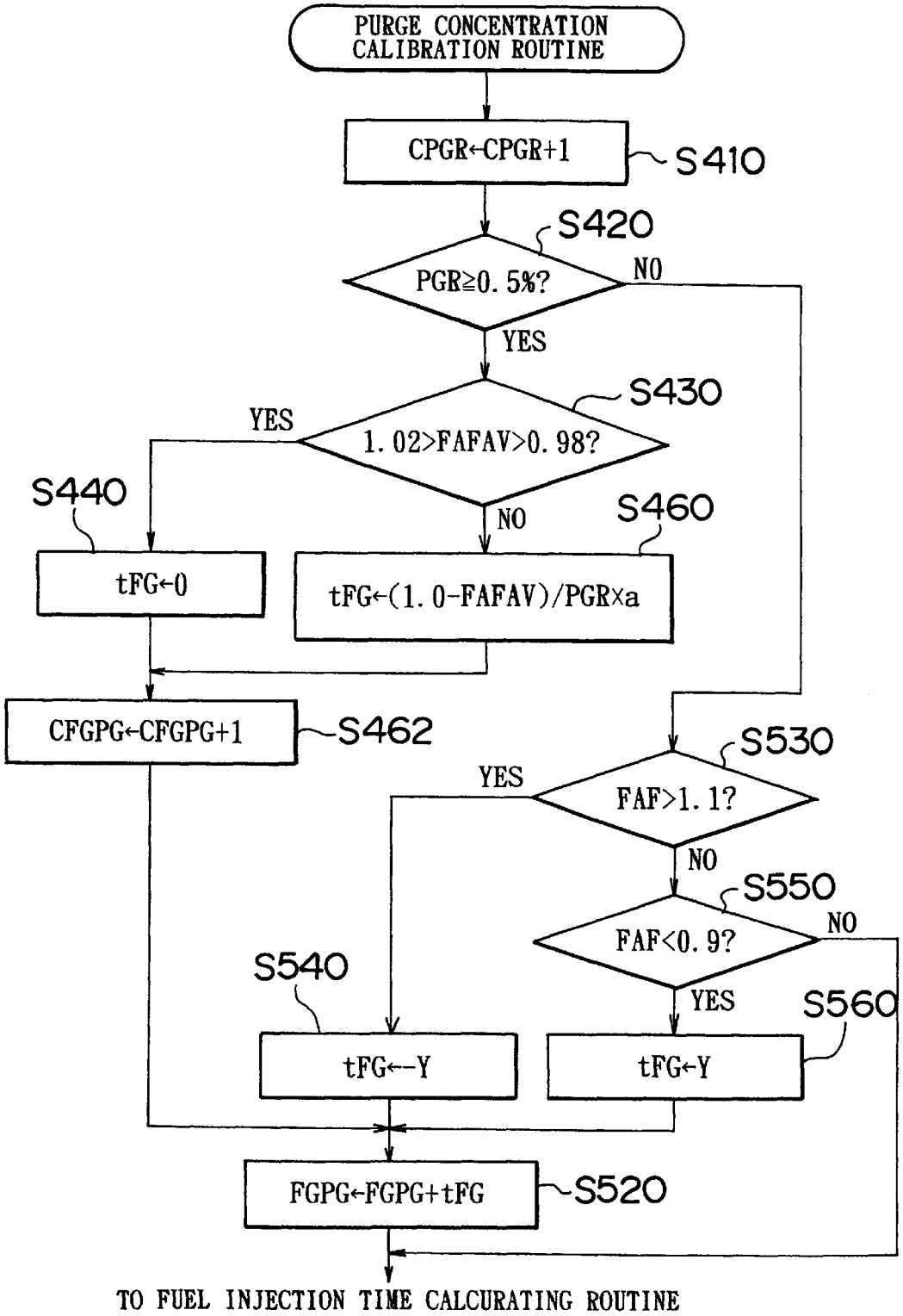
FIG. 6 is a flowchart of a purge concentration calibration routine according to the present invention.

However, if the purge rate, PGR, is not equal to 0 ("NO" in step S340), indicating that purging will be conducted, the control flow proceeds to a purge concentration calibration routine (which will be described later) as shown in FIG. 6.

If the purge rate, PGR, is equal to 0 ("YES" in step S340), indicating that purging will not be conducted, air-fuel ratio calibration is carried out by executing steps S350 through S380.

Step S350 is initially executed to determine if the average value FAFAV, of the air-fuel ratio feedback correction factor, FAF, is greater than or equal to 1.02. If the average value FAFAV is greater than or equal to 1.02 ("YES" in step S350), a certain value X is added to an air-fuel ratio calibration value KGj associated with the current air-fuel ratio calibration region "j" in step S360. In the present embodiment, the air-fuel ratio calibration value is provided with respect to each of the air-fuel ratio calibration regions "j" as described above. In step S360, the air-fuel ratio calibration value, KGj, corresponding to the air-fuel ratio calibration region "j" determined in step S302, is updated.

However, if step S350 determines that the average value, FAFAV, is smaller than 1.02 ("NO" in step S350), step S370 is executed to determine if the average value FAFAV, of the air-fuel ratio feedback correction factor, FAF, is less than or equal to 0.98. If the average value FAFAV, is greater than or equal to 0.98 ("YES" in step S370), a certain value X is subtracted from the air-fuel ratio calibration value, KGj, corresponding to the current air-fuel ratio calibration region "j" in step S380.

When the average value FAFAV, is between 0.98 and 102 ("NO" in step S370), specifically 0.98<FAFAV<1.02, step S382 is executed to set an air-fuel ratio calibration completion flag, XFGAFOKj, corresponding to the air-fuel ratio calibration region "j". The control flow then goes to the next step S390 without updating the air-fuel ratio calibration value, KGj. Step S390 is also executed when a negative decision "NO" is obtained in step S320 or step S334, or after step S360, or step S380, is executed.

In step S390, it is determined if the engine 4 is being started. If the engine is being started ("YES" in step S390), an initialization process for calibration the purge concentration is performed in step S400. During this initialization process, the purge concentration, FGPG, per unit purge rate and purging time count value, CPGE, are set to zero.

Figure 7:
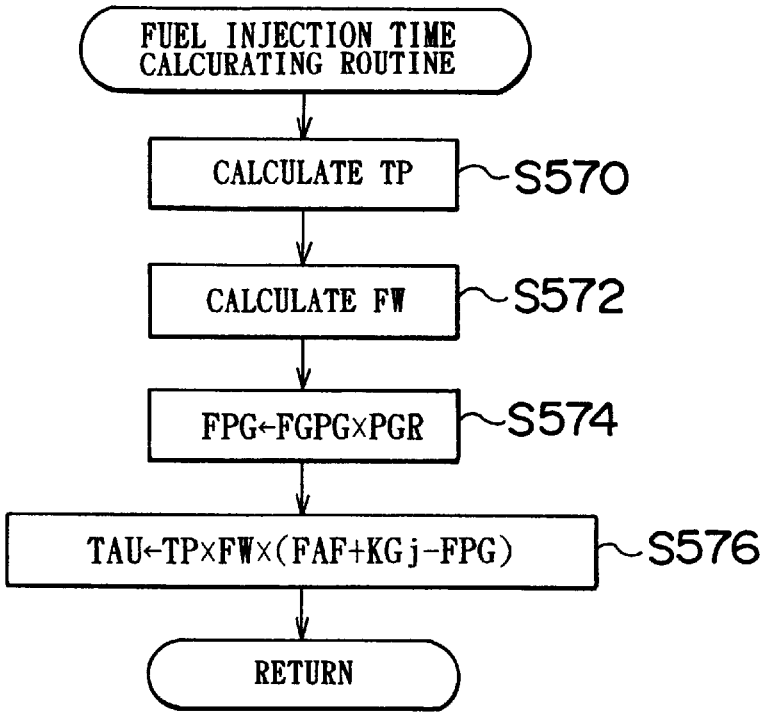
FIG. 7 is a flowchart of a fuel injection time calculating routine according to the present invention.
Figure 8:
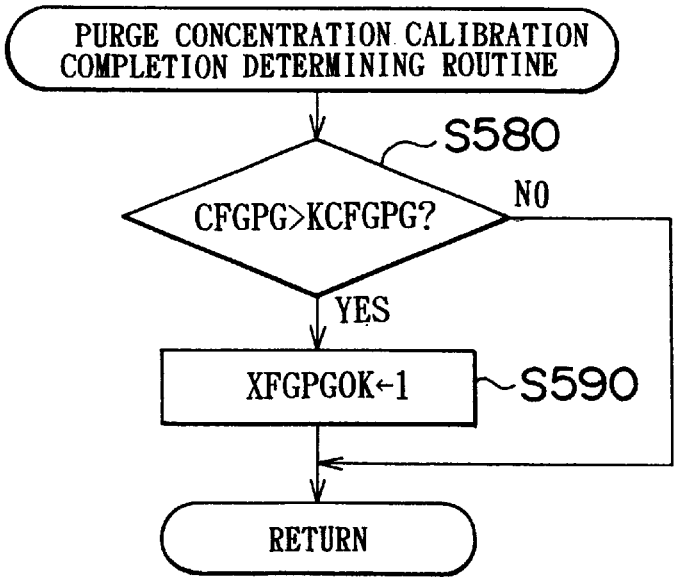
FIG. 8 is a flowchart of a purge concentration calibration completion determining routine according to the present invention.

If a negative decision "NO" is obtained in step S390, or after the initialization process of step S400 is performed, the control flow proceeds to a fuel injection time calculating routine, as shown in the flowchart of FIG. 7.

Next, the purge concentration calibration routine to be executed when a negative decision "NO" is obtained in step S340, is described with reference to the flowchart of FIG. 6.

The routine of FIG. 6 is started with step S410, in which the purging time count value, CPGR, is incremented by 1. Since the purging time count value, CPGR, is set to zero when the engine is started, as described above, the purging time count value, CPGR, represents the time interval during which purging has been conducted after the start of the engine.

Step S420 is then executed to determine if the purge rate, PGR, is greater than or equal to 0.5%. If PGR is greater than or equal to 0.5% ("YES" in step S420) indicating the purge rate, PGR, is extremely small, step S430 is executed to determine if the average value, FAFAV, of the air-fuel ratio feedback correction factor, FAF, falls within the predetermined range, 0.98<FAFAV<1.02. If the average value, FAFAV, of the air-fuel ratio feedback correction factor, FAF, is within the predetermined range ("YES" in step S430), specifically if 0.98<FAFAV<1.02, the update amount, tFG, of the purge concentration, FGPG, per purge rate is set to zero in step S440.

However, step S430 determines that the average value, FAFAV, of the air-fuel ratio feedback correction factor, FAF, is outside the predetermined range ("NO" in step S430), specifically, if FAFAV≧1.02 or FAFAV≦0.98, step S460 is executed to calculate the update amount, tFG, of the purge concentration, FGPG, according to the following expression (2):

$$tFG=(1.0-FAFAV)/PGR\times a \quad (2)$$

where "a" may be equal to 2, for example.

Figure 14:
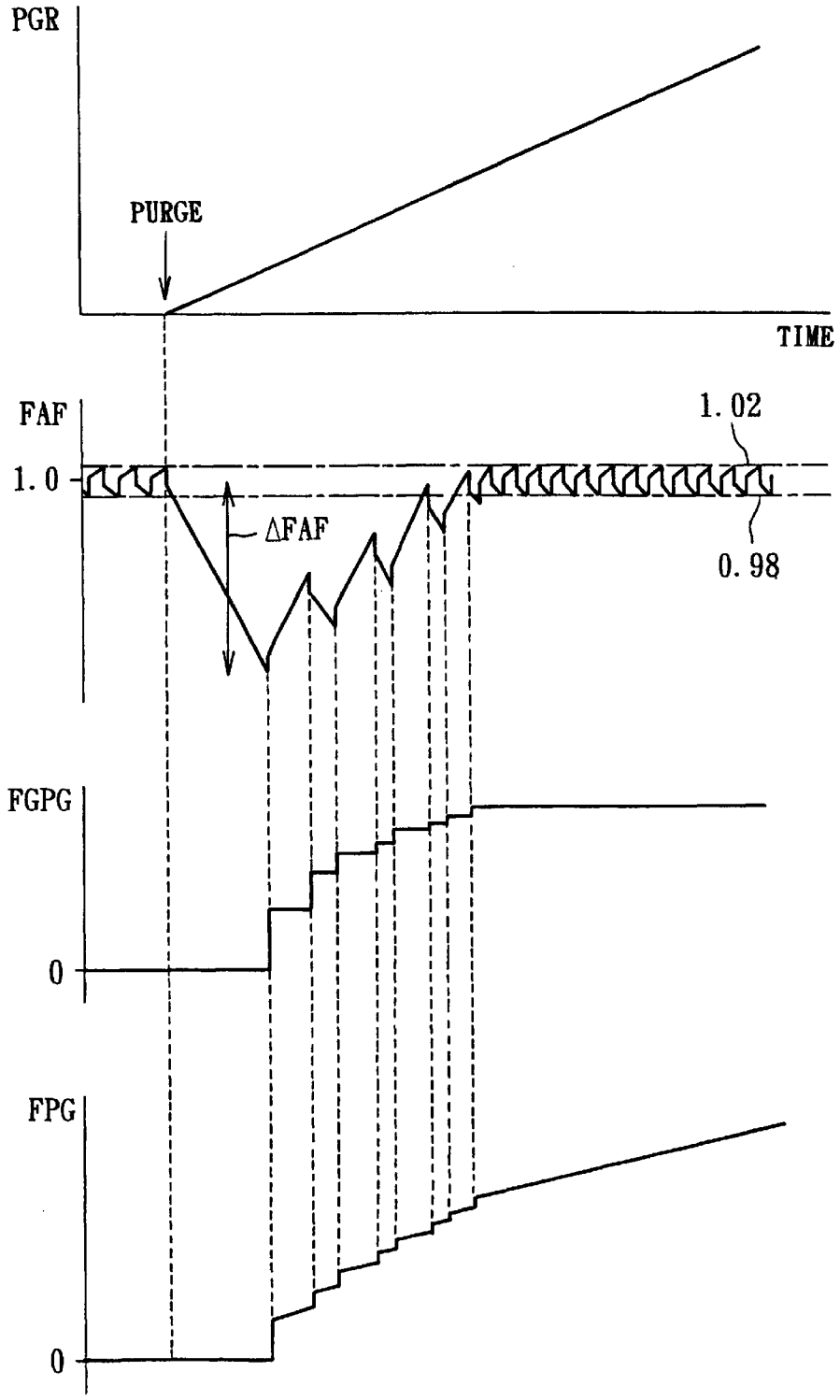
FIG. 14 is a timing chart showing the purge concentration calibration process according to the present invention.
Figure 15:
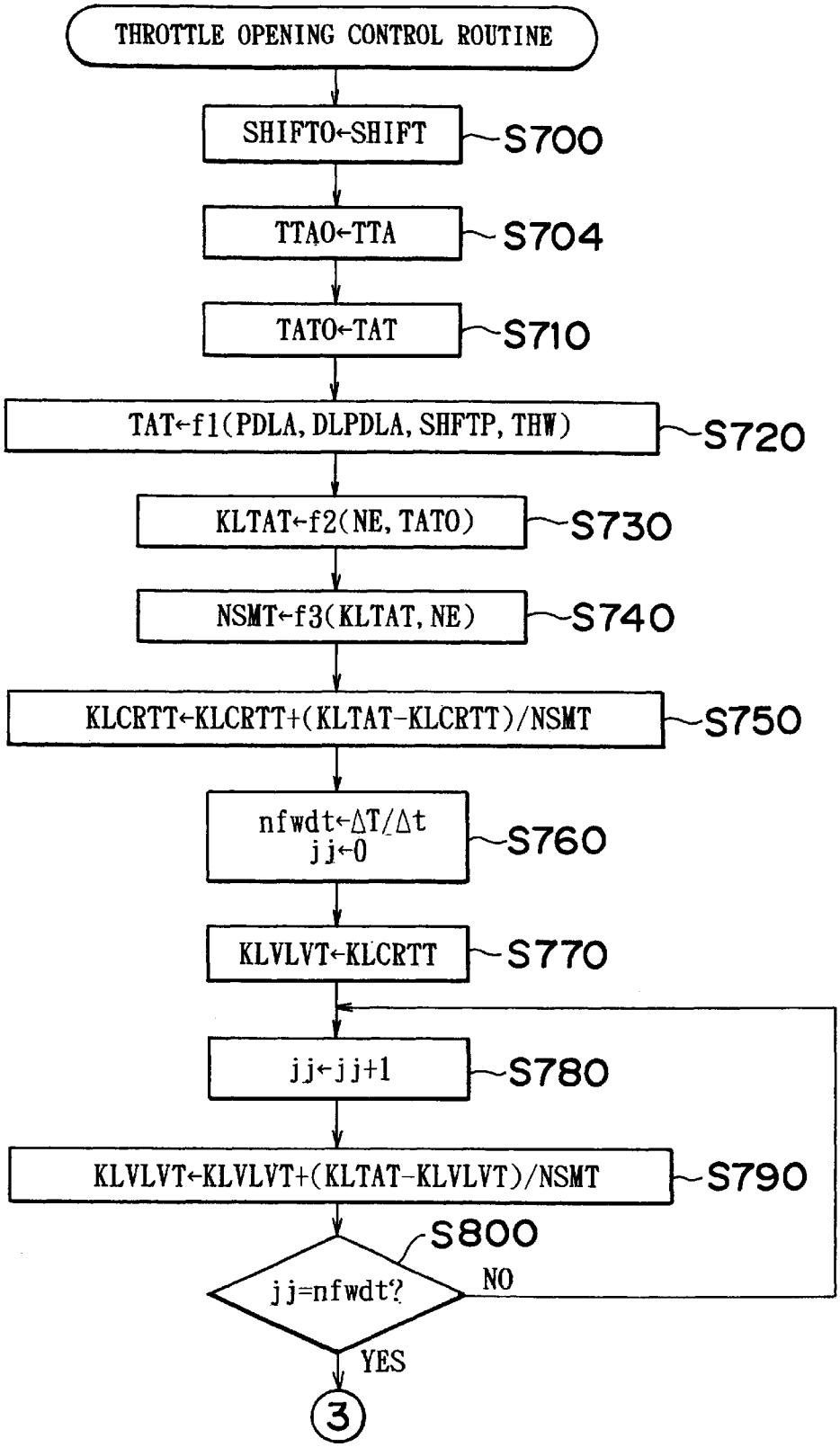
FIG. 15 is a flowchart of a throttle opening control routine according to the present invention.
Figure 16:
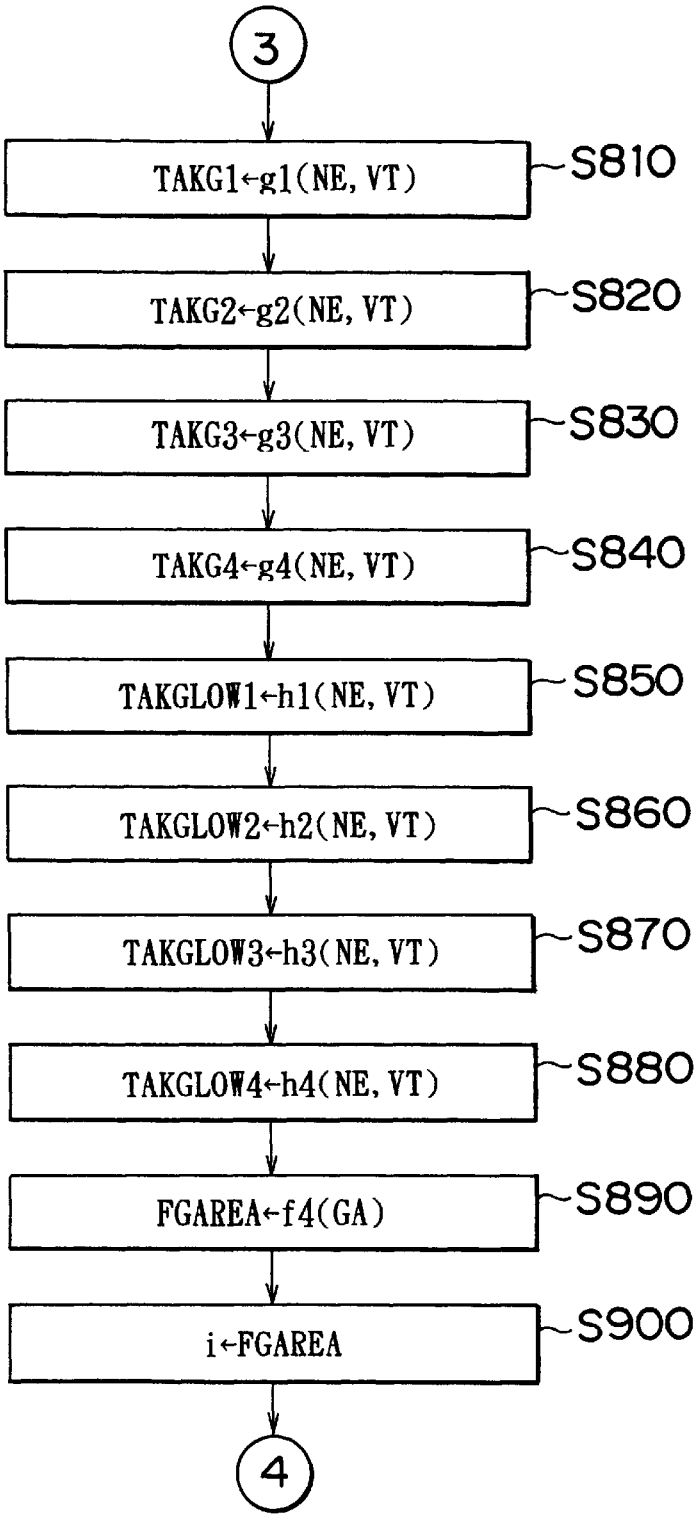
FIG. 16 is a flowchart of the throttle opening control routine of the present invention.

More specifically, if the average value, FAFAV, of the air-fuel ratio feedback correction factor, FAF, lies outside the predetermined range of 0.98 to 1.02, the update amount, tFG, is set to a half of the deviation of FAFAV, from 1.0. In this manner, FAFAV gradually returns to be within the predetermined range, as shown in the timing chart of FIG. 14.

If the update amount, tFG, is determined in step S440, or step S460, step S462 is then executed to increment a purge concentration calibration counter, CFGPG, and step S520 is executed to add the update amount, tFG, to the purge concentration, FGPG. Then, the fuel injection time calculating routine as described in flowchart of FIG. 7, is executed.

The purge concentration calibration counter, CFGPG, that is incremented in step S462, is used in a purge concentration calibration completion determining routine (FIG. 8) that is repeated in the same cycle with the purge concentration calibration routine. In the purge concentration calibration completion determining routine of FIG. 8, step S580 is initially executed to determine if the value of the purge concentration calibration counter, CFGPG, is larger than a specified number of times KCFGPG. If CFGPG is less than or equal to KCFGPG ("NO" in step S580), the routine is terminated. If CFGPG is larger than KCFGPG ("YES" in step S580), a purge concentration calibration completion flag, XFGPGOK, is set in step S590, and the routine is terminated.

Referring back to FIG. 6, if step S420 determines that PGR is less than 0.5% ("NO" in step S420), step S530 is executed to determine whether the air-fuel ratio feedback correction factor, FAF, is larger than 1.1. If FAF is larger than 1.1 ("YES" in step S530), the update amount, tFG, is set to a certain value "−Y" in step S540, and the control flow goes to step S520, as described above.

If step S530 determines that FAF is equal to or smaller than 1.1 ("NO" in step S530), step S550 is executed to determine if the air-fuel ratio feedback correction coefficient, FAF, is less than 0.9. If FAF is less than 0.9 ("YES" in step S550), the update amount, tFG, is set to a certain value "Y" in step S560, and the control flow goes to step S520, as described above.

If step S550 determines that FAF is greater than or equal to 0.9 ("NO" in step S550), the control flow proceeds to the fuel injection time calculating routine of FIG. 7.

If a variation in the air-fuel ratio feedback correction factor, FAF, is indicated by the update amount, tFG, of the purge concentration, FGPG, when the purge rate, PGR, is extremely small, an error in the purge concentration, FGPG, becomes large. In this case, therefore, the purge concentration, FGPG, is updated by a certain small update amount "−Y" or "Y". Additionally, in the case where the air-fuel ratio feedback correction factor FAF varies to a large extent in a positive or negative direction relative to 1.0, the FAF deviates largely from 1.0.

Next, the fuel injection time calculating routine, as shown in the flowchart of FIG. 7, will be explained. Step S570 is initially executed to calculate the basic fuel injection time TP, based on the engine load (the intake air flow rate, GA, in this embodiment) and the engine speed, NE. Step S572 is then executed to calculate a correction factor, FW, used for an increase in the fuel amount during warm-up of the engine. Step S574 is then executed to calculate a purge A/F correction factor, FPG, according to the expression (3) as follows:

$$FPG=FGPG\times PGR \quad (3)$$

where FGPG is the purge concentration per unit purge rate, and PGR is the purge rate.

Then, the fuel injection time, TAU, is calculated in step S576 according to the expression (4) as follows.

$$TAU=TP\times FW\times(FAF+KGj-FPG) \quad (4)$$

Figure 9:
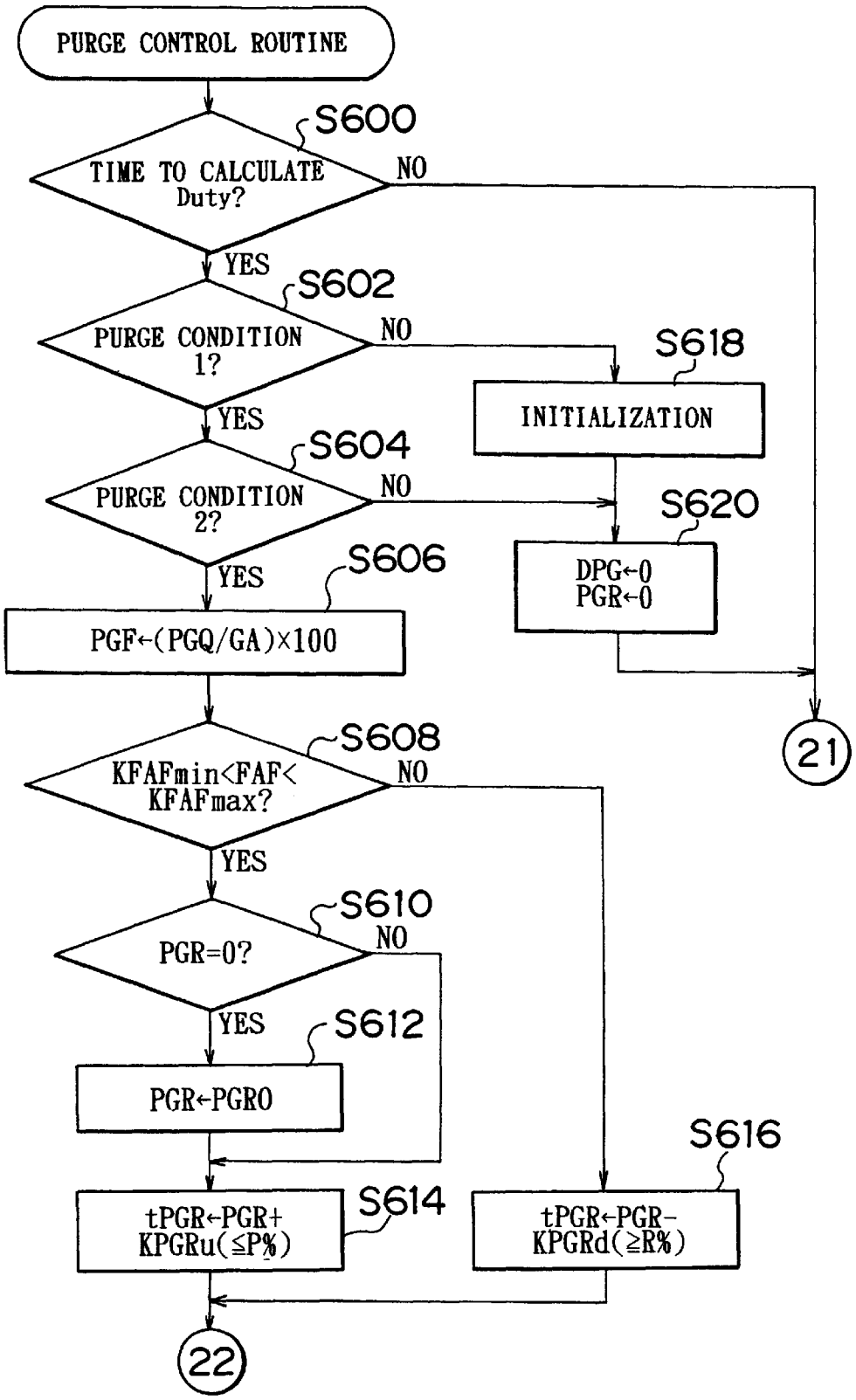
FIG. 9 is a flowchart of a purge control routine according to the present invention.
Figure 10:
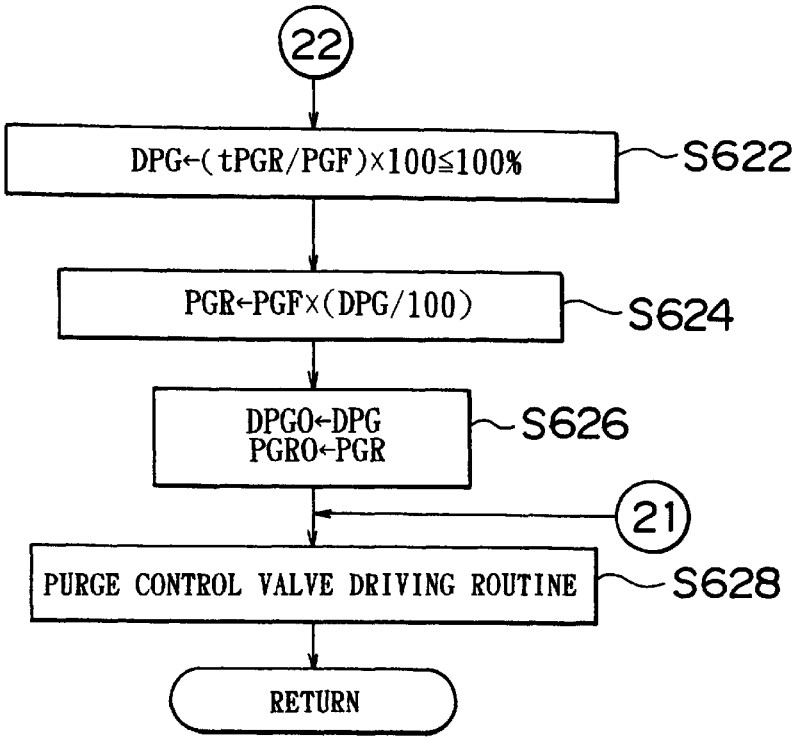
FIG. 10 is a flowchart of a purge control routine according to the present invention.
Figure 11:
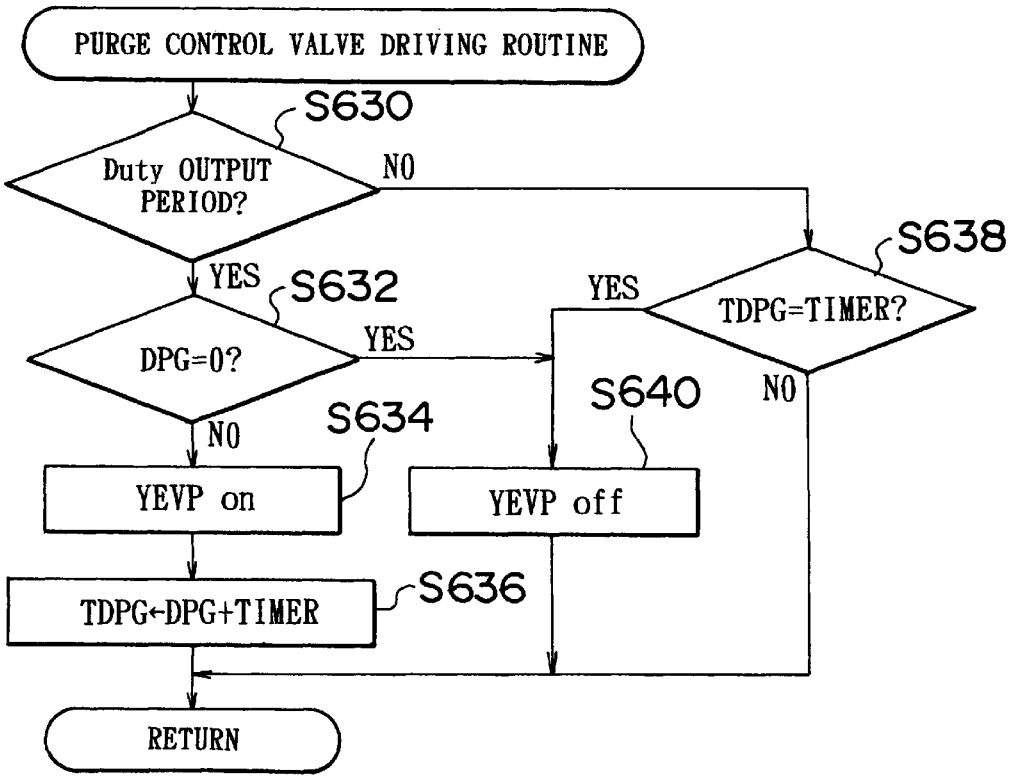
FIG. 11 is a flowchart of a purge control valve driving routine according to the present invention.

Next, purge control based on the above-described purge concentration calibration routine is executed, as described in FIGS. 9 through 11.

The flowcharts of FIGS. 9 and 10 show a purge control routine. The present purge concentration routine is executed periodically by interrupting the fuel injection routine at regular intervals.

Upon the start of the purge control routine, step S600 determines if it is time to calculate the duty of drive pulses of the purge control valve 99. For example, the duty is calculated every 100 msec. If it is not the time to calculate the duty ("NO" in step S600), a routine (FIG. 11) for driving the purge control valve 99, as described later, is executed in step S628.

However, it is time to calculate the duty ("YES" in step S600), step S602 is executed to determine if a purge condition 1 is satisfied, determining whether warm-up of the engine has been completed. If the purge condition 1 is not satisfied ("NO" in step S602), the initialization process is performed in step S618, the duty, DPG, and the purge rate, PGR, are set to zero in step S620, and the routine (FIG. 11) for driving the purge control valve 99 is executed in step S628.

However, if the purge condition 1 is satisfied ("YES" in step S602), step S604 is executed to determine if a purge condition 2 is satisfied, determining whether the air-fuel ratio feedback control is performed. If the purge condition 2 is not satisfied ("NO" in step S604), the control flow goes to step S620, as described above.

If the purge condition 2 is satisfied ("YES" in step S604), the full-open purge rate PGF is calculated in step S606 according to the expression (5) as follows:

$$PGF=(PGQ/GA)\times 100 \quad (5)$$

where PGQ is the purge amount (full-open purge amount) the purge control valve 99 is fully opened.

Figure 12:
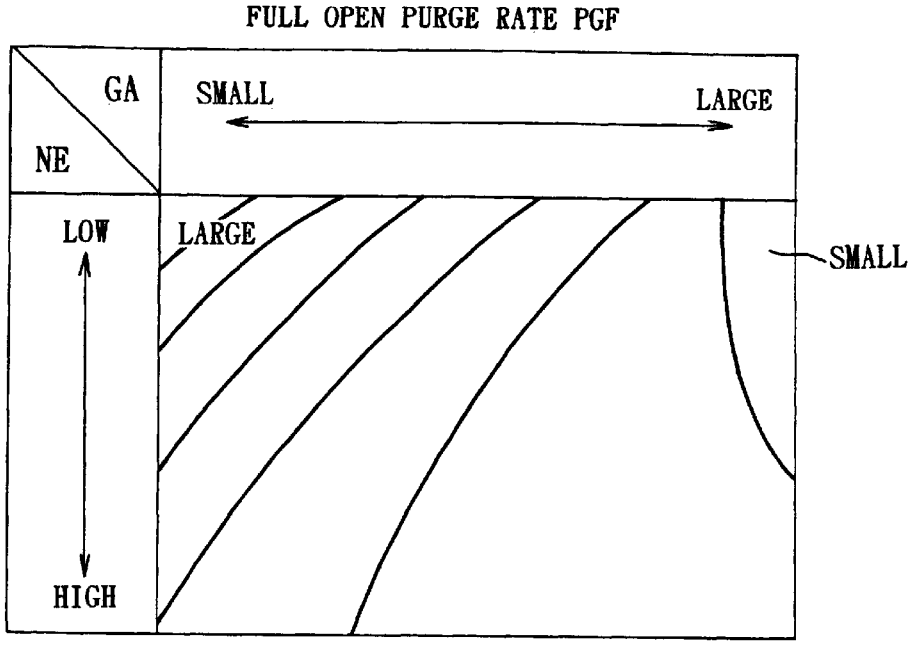
FIG. 12 is an exemplary diagram for obtaining the full-open purge rate PGF used in the present invention.

As shown in FIG. 12, the full-open purge rate, PGF, is determined in advance by actual measurements of the engine speed, NE, and the engine load (the intake air flow rate GA in this embodiment), which are stored in the ROM **50*b*. In FIG. 12, the trend of numerical values of the full-open purge rate, PGF, is expressed by contour or level lines. It will be understood from FIG. 12** that the full-open purge rate, PGF, tends to increase as the intake air flow rate GA decreases, and the full-open purge rate PGF tends to decrease as the intake air flow rate GA increases. Also, the full-open purge rate, PGF, tends to increase as the engine speed, NE is reduced. In a portion of the map in which the intake air flow rate, GA, is extremely large, the full-open purge rate, PGF, tends to decrease as the engine speed, NE, is lowered.

Subsequently, step S608 is executed to determine if the air-fuel ratio feedback correction factor, FAF, is between the lower limit value KFAFmin (=0.85) and the upper limit value KFAFmax (=1.15). If KFAFmin<FAF<KFAFmax ("YES" in step S608), indicating the air-fuel ratio is feedback-controlled to the stoichiometric (A/F) ratio, step S610 is executed to determine if the purge rate, PGR, is zero.

Since PGR is equal to 0 before starting ("YES" in step S610), the purge rate PGR0, established immediately before purge control was cancelled, is reset to the purge rate, PGR, to resume the purge rate in step S612. When the purge condition 1 and purge condition 2 are satisfied for the first time, after the start of the engine 4, the purge rate, PGR0, has been initialized to zero in step S618. In this case, therefore, the purge rate, PGR, is made equal to 0 in step S612. When purging is resumed or restarted after an interruption during a continuous operation of the engine 4, the purge rate, PGR0, is set to the purge rate, PGR, before actual interruption of the purge control in step S612.

Step S612 is followed by step S614. Step S614 is also executed when purging has been already conducted with PGR being greater than 0, and a negative decision (NO) is obtained in step S610.

In step S614, a target purge rate, tPGR, is calculated according to the expression (6) as follows:

$$tPGR=PGR+KPGRu \quad (6)$$

where KPGRu is a certain value.

It will be understood that when KFAFmin<FAF<KFAFmax, the target purge rate, tPGR, increases gradually every 100 msec. With regard to the increase in the target purge rate, tPGR, the upper limit value P (for example, 6%) is established.

If step S608 determines that FAF is greater than or equal to KFAFmax (FAF≧KFAFmax) or FAF is greater than or equal to KFAFmin (FAF≦KFAFmin) ("NO" in step S608), the target purge rate, tPGR, is calculated in step S616 according to the expression (7) as follows:

$$tPGR=PGR-KPGRd \quad (7)$$

where KPGRd is a certain value.

Namely, when the air-fuel ratio cannot be maintained at the stoichiometric (A/F) ratio due to purging of vaporized fuel, the target purge rate, tPGR, is reduced. With regard to the target purge rate, tPGR, the lower limit value R (R=0%) is established.

Following step S614 or step S616, as described above, step S622 is executed to calculate the duty, DPG, of drive pulses of the purge control valve 99 according to the expression (8) as follows:

$$DPG=(tPGR/PGF)\times 100\leqq 100\% \quad (8)$$

where "<100%" means that the upper limit of the calculated value is 100%.

According to the above expression (8), the duty, DPG, of drive pulses of the purge control valve 99, i.e., the opening of the purge control valve 99, is controlled in accordance with the ratio of the target purge rate, tPGR, to the full-open purge rate, PGF. Thus, if the opening of the purge control valve 99 is controlled depending upon the ratio of the target purge rate, tPGR, to the full-open purge rate, PGF, the actual purge rate can be maintained at the target purge rate, irrespective of the operating conditions of the engine 4 and the value of the target purge rate, tPGR.

For example, if tPGR is equal to 2%, and PGF is equal to 10% under the current operating conditions of the engine 4, DPG will equal 20%, and the actual purge rate will equal 2%. If PGF is 5%, due to changes in the engine operating conditions, DPG will equal 40%, and the purge rate will equal 2%. Thus, as long as the target purge rate, tPGR, is 2%, the actual purge rate is maintained at 2% irrespective of the operating conditions of the engine 4.

In the next step S624, the actual purge rate, PGR, is calculated according to the expression (9) as follows.

$$PGR=PGF\times(DPG/100) \quad (9)$$

The duty, DPG, is represented by the expression (8) as described above, and, if the target purge rate, tPGR, becomes greater than the full-open purge rate, PGF, the duty, DPG, would be greater than 100%. However, the upper limit of the duty, DPG, is 100% as indicated in the expression (8) since the duty, DPG, cannot exceed 100%. Hence, the actual purge rate, PGR, is made smaller than the target purge rate, tPGR. Accordingly, the actual purge rate, PGR, is determined as indicated by the expression (9).

Step S626 is then executed to set the duty, DPG, to DPG0, and set the purge rate, PGR, to PGR0.

Next, the routine (S628) for driving the purge control valve 99 is executed. The purge control valve driving routine will be now described referring to the flowchart of FIG. 11.

In the purge control valve driving routine, step S630 is initially executed to determine if the current cycle is in a duty output period, specifically if a drive pulse of the purge control valve 99 is in a rise-time. In the present embodiment, the duty output period is 100 msec.

If the current cycle is in a duty output period ("YES" in step S630), step S632 is executed to determine if the duty, DPG, is zero. If DPG is equal to zero ("YES" in step S632), the drive pulse, YEVP, of the purge control valve 99, is turned OFF in step S640. If DPG is not equal to 0 ("NO" in step S632), the drive pulse, YEVP, of the purge control valve 99, is turned ON in step S634. Step S636 is then executed to calculate the OFF time, TDPG, of the drive pulse according to the expression (10) as follows:

$$TDPG=DPG+TIMER \quad (10)$$

where TIMER is the current time.

If step S630 determines that the current cycle is not in a duty output period ("NO" in step S630), step S638 is executed to determine if the current time, TIMER, is the OFF time, TDPG, of the drive pulse. If TDPG is not equal to TIMER ("NO" in step S638), the routine is ended. However, if TDPG is equal to TIMER ("YES" in step S638), the drive pulse, YEVP, is turned OFF in step S640, and the present routine is ended.

With the purge control performed in the manner as described above, the opening of the purge control valve 99, is controlled.

Next, throttle opening control will be described which is performed concurrently with the following: the above-described air-fuel ratio control in which the air-fuel ratio feedback correction factor, FAF, is calculated, purge control routine, air-fuel ratio learning routine, and the purge concentration learning routine.

The throttle opening control routine is shown in the flowcharts of FIG. 15 through FIG. 20. For example, the throttle opening control routine is repeatedly executed at regular intervals.

Initially, a control shift position, SHIFT, calculated in the last cycle of the control routine, is set to a variable SHIFT0 in the RAM 50*c*, in step S700. In step S704, a target throttle opening, TTA, obtained in the last cycle is set to a variable TTA0 in the RAM 50*c*.

In step S710, a throttle opening, TAT, that was calculated in the last cycle of the routine is not subjected to a load fixing operation (which will be referred to as "non-fixed throttle opening") is set to a variable TAT0 in the RAM 50*a*.

Next, the accelerator pedal position, PDLA, shift position SHFTP, and coolant temperature, THW, detected by the accelerator position sensor 40, shift position sensor 96, and the water temperature sensor 94, are read. Also, the rate of change, DLPDLA, between the accelerator pedal position, PDLA, in the last cycle and the accelerator pedal position, PDLA, in the current cycle, are calculated. Based on these values PDLA, SHFTP, THW, and DLPLDA, a new non-fixed throttle opening, TAT, is obtained from a map f1 and stored in ROM 50*b* in step S720.

Based on the variable TAT0 (hereinafter referred to as "last-cycle non-fixed throttle opening") representing the non-fixed throttle opening, TAT, obtained in the last cycle and the engine speed, NE, the charging efficiency, KLTAT, of the engine 4 (hereinafter called "non-fixed steady-state charging efficiency") taken in a steady state under current engine speed, NE, and the last non-fixed throttle opening, TAT0, is obtained from a map f2 stored in the ROM 50*b* in step S720.

In step S740, a response delay time constant (hereinafter referred to as "non-fixed time constant") NSMT, used in the control of the intake air flow rate through the throttle valve 32 is obtained from a map f3 stored in the ROM 50*b*, based on the non-fixed steady-state charging efficiency, KLTAT, and the engine speed, NE. The non-fixed time constant, NSMT, thus obtained is a positive integer. The non-fixed charging efficiency, KLCRTT, is calculated in step S750 according to the expression (11) as follows:

$$KLCRTT=KLCRTT+(KLTAT-KLCRTT)/NSMT \quad (11)$$

where KLCRTT on the right side is the non-fixed charging efficiency in the last cycle.

In the next step S760, the number of times "nfwdt" of calculation of the expression (12) for calculating the charging efficiency (hereinafter referred to as "non-fixed charging efficiency upon intake valve closing") KLVLVT at the point of time when the intake valve is closed, is determined for a period of time ΔT. ΔT is the period of time required to close the intake valve. The period or duration of calculation ΔT (nfwdt=ΔT/Δt), and a variable "jj" set in the RAM 50*c* is reset to zero.

Next, Step S770 is executed to reset the non-fixed charging efficiency KLCRTT to the current time, which was obtained in step S750, as the initial value of the non-fixed charging efficiency, KLVLVT, upon intake valve closing.

Step S780 is executed to increment the value of the variable "jj", and step S790 is executed to calculate the non-fixed charging efficiency, KLVLVT, upon intake valve closing according to the expression (12) as follows.

$$KLVLVT=KLVLVT+(KLTAT-KLVLVT)/NSMT \quad (12)$$

Step S800 is then executed to determine whether the value of the variable "jj" coincides with the number of times of calculation "nfwdt". If "jj" is still smaller than "nfwdt" even with an increment in step S780 ("NO" in step S800), the operations of step S780 through step S800 are repeated again. In this manner, the calculation as represented by the expression (12) is repeatedly performed as long as "jj" is smaller than "nfwdt" ("NO" is obtained in step S800), and the non-fixed charging efficiency, KLVLVT, based upon intake valve closing, is updated each time step S790 is executed.

If the variable "jj" becomes equal to "nfwdt" ("YES" in step S800), the control flow goes to the next stage (S810). Thus, the updating calculation as represented by the expression (12) is finished after it is repeated the predetermined number of times "nfwdt". The throttle opening, TA, is controlled in accordance with the torque required by the driver. Therefore, the charging efficiency in the timing of opening of the intake valve can be obtained as the non-fixed charging efficiency, KLVLVT, upon intake valve closing.

In the following steps S810 through S840, the reference throttle opening TAKG (n=1, 2, 3, 4) is obtained from a map gn (n=1, 2, 3, 4) stored in the ROM 50*b*, based on the engine speed, NE, obtained from a signal of the engine speed sensor 90 and the valve timing, VT, of the intake valve obtained from a signal of the cam angle sensor 54. The reference throttle opening TAKG (n=1, 2, 3, 4) is such a throttle opening that realizes a reference intake air flow rate located at the center of the n-th air-fuel ratio calibration region under the conditions of the current engine speed, NE, and valve timing, VT.

In the above manner, the reference throttle openings, TAKG1, through TAKG4, for all of the air-fuel ratio calibration regions are obtained.

The intake air flow rate, GA, is smallest in the first air-fuel ratio calibration region (n=1), and the number of region increases as the intake air flow rate, GA, increases. It follows that the intake air flow rate, GA, is largest in the fourth air-fuel ratio calibration region (n=4).

In the following steps S850 through S880, the lower-limit throttle opening, TAKGLOWn (n=1, 2, 3, 4) is obtained from a map hn (n=1, 2, 3, 4) stored in the ROM 50*b*, based on the engine speed, NE, and the valve timing, VT, of the intake valve. The lower-limit throttle opening TAKGLOWn (n=1, 2, 3, 4) represents a throttle opening corresponding to the minimum output torque to which the output torque corresponding to the reference throttle opening, TAKGn (n=1, 2, 3, 4) can be reduced, by controlling parameters, other than the intake air flow rate, GA, such as ignition timing, as described later.

Step S890 is then executed to calculate the current air-fuel ratio learning region, FGAREA, based on the intake air flow rate, GA, detected by the air flow meter 68. This calculating operation is the same as that of step S302 of the air-fuel ratio calibration routine (FIG. 4) as described above. Accordingly, the result of calculation in step S302 may be read in step S890.

Figure 17:
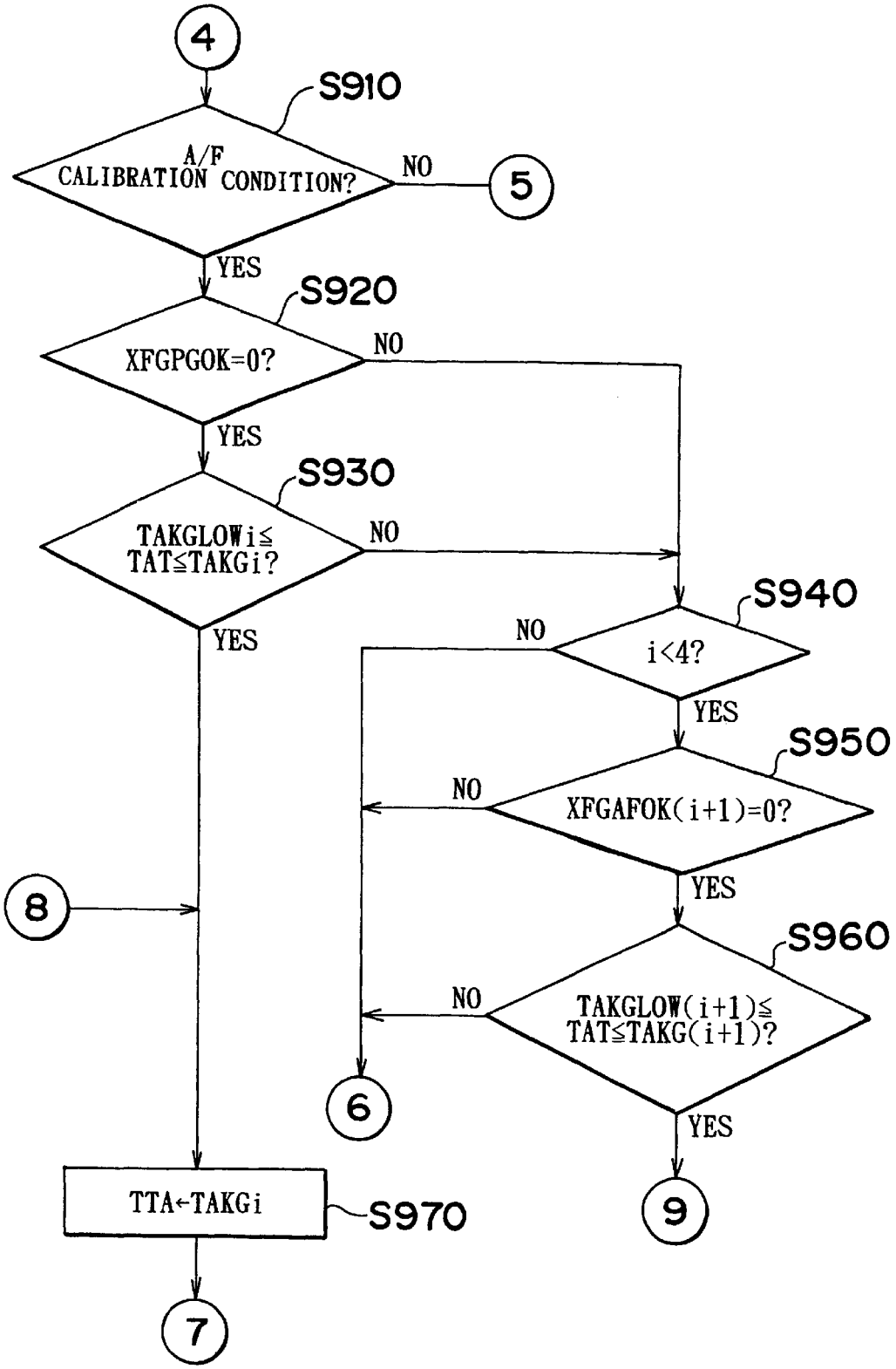
FIG. 17 is a flowchart of the throttle opening control routine of the present invention.
Figure 18:
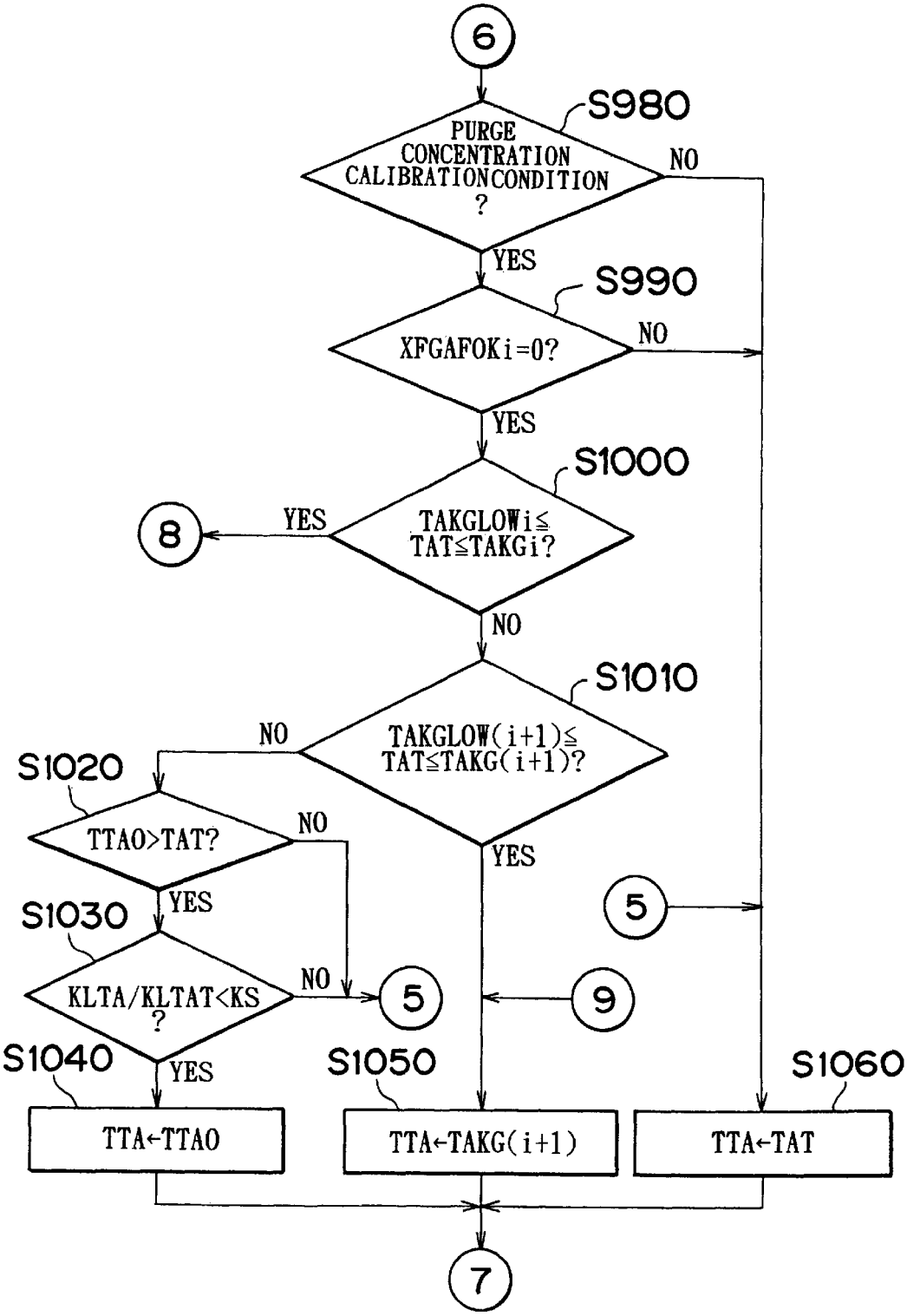
FIG. 18 is a flowchart of the throttle opening control routine of the present invention.
Figure 19:
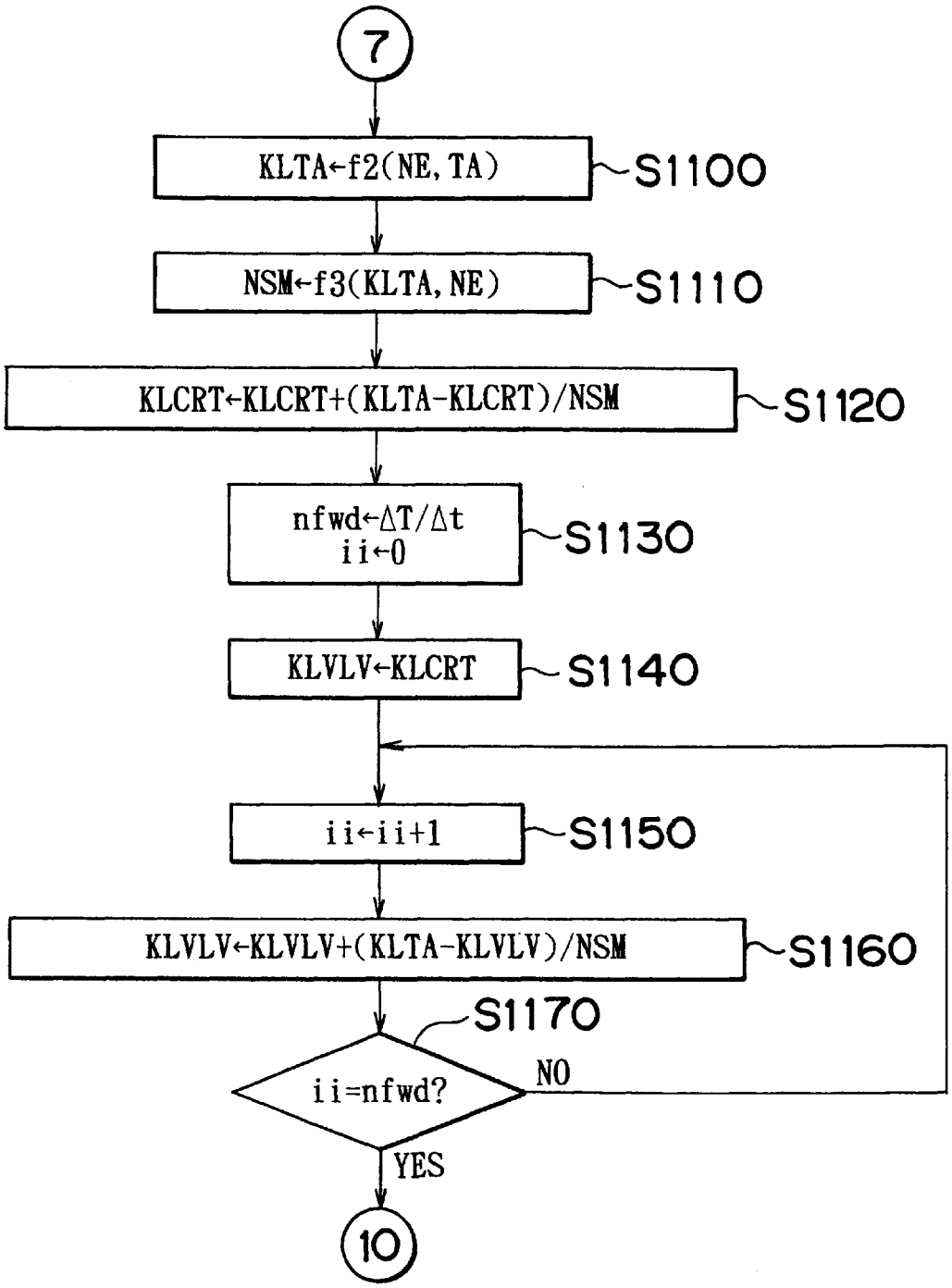
FIG. 19 is a flowchart of the throttle opening control routine of the present invention.
Figure 20:
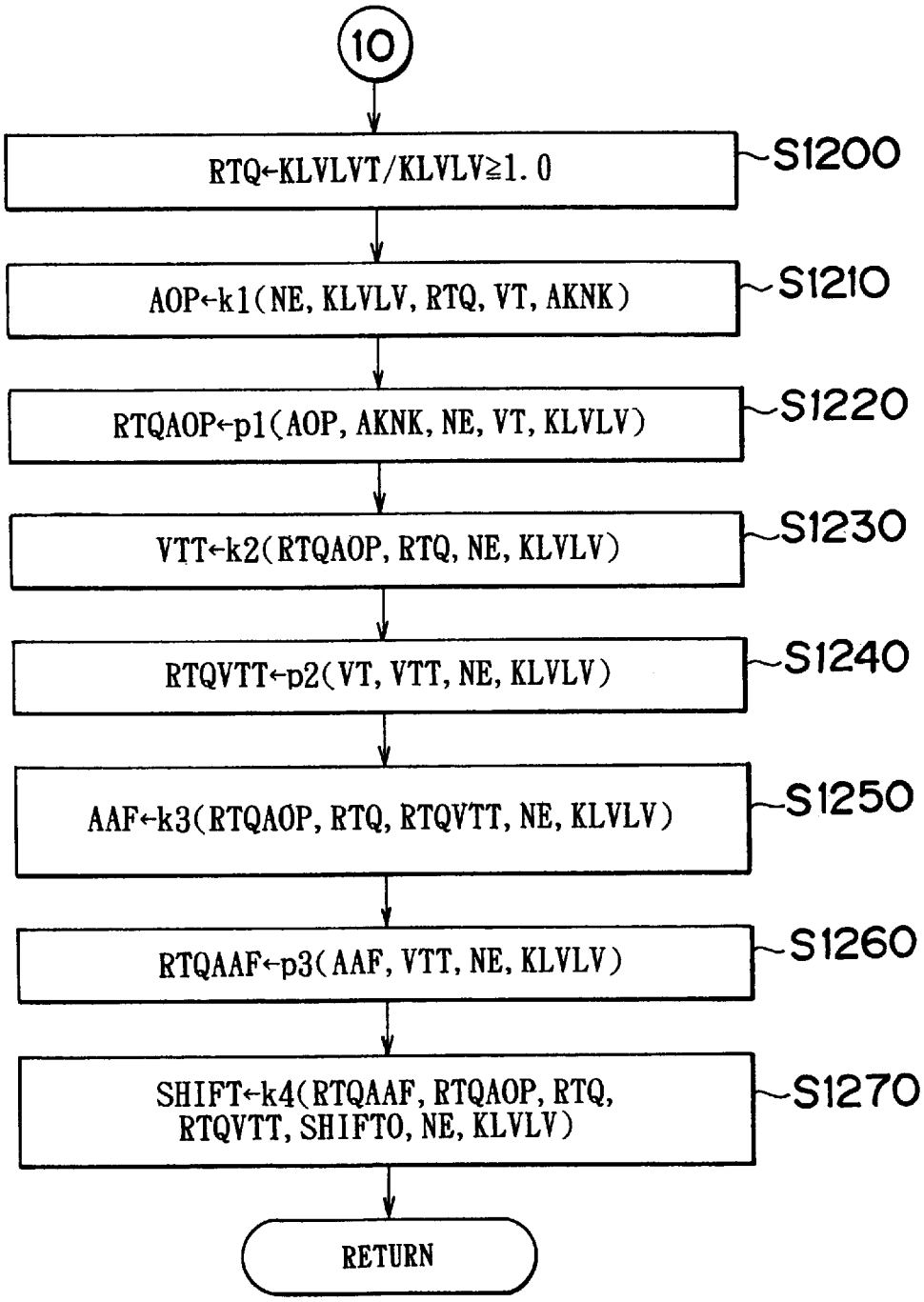
FIG. 20 is a flowchart of the throttle opening control routine of the present invention.

Step S900 is then executed to set the air-fuel ratio calibration region, FGAREA, to a variable "i" set in the RAM 50*c*. Then, the control flow proceeds as shown in FIGS. 17 and 18, determining the target throttle opening, TTA.

Initially, step S910 determines if the air-fuel ratio calibration conditions are satisfied. This determination is the same as step S310 of the air-fuel ratio calibration routine (FIG. 4).

If the air-fuel ratio calibration conditions are not satisfied ("NO" in step S910), the non-fixed throttle opening, TAT, obtained in step S720 is set to the target throttle opening, TTA, in step S1060.

If step S910 determines that the air-fuel ratio calibration conditions are satisfied ("YES" in step S910), step S920 is executed to determine if the air-fuel ratio calibration completion flag, XFGAFOKi, indicating that the air-fuel ratio calibration has been completed, is in the reset state in the i-th air-fuel ratio calibration region as the current air-fuel ratio calibration region.

If XFGAFOKi is equal to zero (or in the reset state) indicating that the air-fuel ratio calibration has not yet been completed in the current air-fuel ratio calibration region ("YES" in step S920), step S930 is executed to determine if the non-fixed throttle opening, TAT, set in step S720 satisfies the relationship of the following expression (13):

$$TAKGLOWi \leqq TAT \leqq TAKGi \quad (13)$$

where TAKGi represents the reference throttle opening associated with the i-th air-fuel ratio learning region, and TAKGLOWi represents the low-limit throttle opening in the i-th air-fuel ratio learning region. Determining if the output torque can be adjusted to be equivalent to the output torque corresponding to the non-fixed throttle opening, TAT, by adjusting the ignition timing and others, with the throttle opening shifted to the reference throttle opening, TAKGi, in the current air-fuel ratio calibration region so that the engine load set to a fixed value.

If the relationship (13) is satisfied ("YES" in step S930), step S970 is executed to set the reference throttle opening TAKGi to the target throttle opening, TTA.

If the relationship (13) is not satisfied ("NO" in step S930), or if step S920 determines that XFGAGOKi is set to 1 ("NO" in step S920), step S940 is executed to determine if the variable "i" is less than 4 which indicates if the engine is currently in one of the first to third air-fuel ratio calibration regions.

If the engine is currently in one of the first to third air-fuel ratio calibration regions ("YES" in step S940), step S950 is executed to determine whether the air-fuel ratio calibration completion flag XFGAFOK(i+1) indicating completion of air-fuel ratio calibration is in the reset state, in the (i+1)-th air-fuel ratio calibration region located adjacent to the current region on the side of the larger intake air flow rate, GA. If XFGAFOK(i+1) is equal to zero ("YES" in step S950), step S960 is executed to determine if the non-fixed throttle opening, TAT, set in step S720, satisfies the relationship of the following expression (14).

$$TAKGLOW(i+1) \leqq TAT \leqq TAKG(i+1) \quad (14)$$

Namely, it is determined whether the output torque can be adjusted to be equivalent to the output torque corresponding to the non-fixed throttle opening, TAT, by adjusting the ignition timing and others, where the throttle opening is shifted to the reference throttle opening TAKG(i+1) in the (i+1)-th air-fuel ratio calibration region so that the engine load is fixed. This step makes it possible to find out whether the engine load can be adjusted, even under the situation that the non-fixed throttle opening, TAT, is larger than the reference throttle opening, TAKGi, in the current i-th air-fuel ratio calibration region.

Where TAT is larger than TAKGi, the output torque is reduced if the reference throttle opening, TAKGI, in the current i-th air-fuel ratio calibration region is set to the target throttle opening TTA, and the output torque cannot be suitably adjusted by reducing the output torque utilizing the ignition timing, or the like. Although, it is possible to adjust the output torque to the non-fixed throttle opening, TAT, by reducing the output torque with the ignition timing, for example, if the output torque is increased by shifting the throttle opening to the reference throttle opening TAKG(i+1) in the (i+1)-th air-fuel ratio calibration region.

If the relationship (14) is satisfied ("YES" in step S960), the reference throttle opening TAKG(i+1) of the (i+1)-th air-fuel ratio calibration region is set to the target throttle opening, TTA, in step S1050.

Where step S940 determines that "i" is equal to 4 ("NO" in step S940), or where step S950 determines that XFGAFOK(i+1) is equal to 1 ("NO" in step S950), or where step S960 determines that the relationship (14) is not satisfied ("NO" in step S960), the control flow goes to step S980.

In step S980, it is determined if the purge concentration calibration conditions are satisfied. For example, the same operation as that in step S340 is performed, and it is determined if the conditions under which purge concentration calibration routine (FIG. 6) is executed are satisfied.

If the purge concentration learning conditions are not satisfied ("NO" in step S980), the non-fixed throttle opening, TAT, obtained in step S720 is set to the target throttle opening, TTA, in step S1060.

If the purge concentration calibration conditions are satisfied ("YES" in step S980), step S990 is executed to determine if the purge concentration calibration completion flag, XFGPGOK, indicating completion of purge concentration calibration, is reset.

If the purge concentration calibration completion flag, XFGPGOK, has been set to 1, which means that the calibration of the purge concentration has been completed ("NO" in step S990), the non-fixed throttle opening, TAT, obtained in step S720 is set to the target throttle opening, TTA, in step S1060.

If the purge concentration calibration completion flag, XFGPGOK, is reset ("YES" in step S990), step S1000 is executed to determine if the non-fixed throttle opening, TAT, set in step S720 satisfies the relationship of the above-indicated expression (13). Determining whether the output torque can be adjusted to be to the non-fixed throttle opening, TAT, by adjusting the ignition timing and others, where the throttle opening is shifted to the reference throttle opening, TAKGi, in the current air-fuel ratio calibration region so that the engine load is set to a fixed value.

If the relationship of the expression (13) is satisfied ("YES" in step S1000), indicating if the output torque can be adjusted to the required level through adjustment of the ignition timing and others, step S970 is executed to set the reference throttle opening, TAKGi, to the target throttle opening, TTA.

If the relationship of the expression (13) is not satisfied ("NO" in step S1000), indicating if the output torque cannot be adjusted to the required level through adjustment of the ignition timing and others, step S1010 is executed to determine if the non-fixed throttle opening, TAT, set in step S720, satisfies the relationship of the expression (14).

If the relationship of the expression (14) is satisfied, the output torque can be adjusted to be equivalent to the output torque obtained with the non-fixed throttle opening, TAT, through adjustment of the ignition timing and other factors, even if the reference throttle opening TAKG(i+1) of the (i+1)-th air-fuel ratio calibration region is set to the target throttle opening, TTA, so that the engine load is fixed. If an affirmative decision (YES) is obtained in step S1010, therefore, step S1050 is executed to set the reference throttle opening TAKG(i+1) of the (i+1)-th air-fuel ratio calibration region to the target throttle opening, TTA If step S1010 determines that the relationship of the expression (14) is not satisfied ("NO" in step S1010), step S1020 is executed to determine if the non-fixed throttle opening, TAT, set in step S720 is smaller than the target throttle opening, TTA0, obtained in the last cycle. If TTA0 is less than or equal to TAT ("NO" in step S1020), indicating an increase in the non-fixed throttle opening, TAT, or a rise in the required torque, the non-fixed throttle opening, TAT, obtained in step S720, is set to the target throttle opening, TTA, in step S1060.

If TTA0 is larger than TAT ("YES" in step S1020), step S1030 is executed to calculate the ratio (KLTA/KLTAT) of the steady-state charging efficiency, KLTA obtained based on the throttle opening, TA, detected by the throttle sensor 36, as described later, to the non-fixed steady-state charging efficiency, KLTAT, obtained in step S730, and indicating if the ratio (KLTA/KLTAT) is smaller than a reference value KS. If the required torque decreases by a larger degree even if "YES" is obtained in step S1020, the output torque cannot be sufficiently reduced by adjusting the ignition timing and other factors. Whether the required torque drops by a large degree can be determined by comparing the ratio (KLTA/KLTAT) with the reference value, KS, because the non-fixed steady-state charging efficiency, KLTAT, is greatly reduced in that case.

If step S1030 determines that KLTA/KLTAT is smaller than KS ("YES" in step S1030), step S1040 is executed to set the value of the target throttle opening TTA0, obtained in the last cycle to the target throttle opening, TTA. Thus, the value of the target throttle opening, TTA, does not change and the engine load can be adjusted.

If step S1030 determines that the ratio, KLTA/KLTAT, is greater than or equal to KS ("NO" in step S1030), it is found that the output torque cannot be sufficiently reduced utilizing adjustment of the ignition timing and other factors. Accordingly, the non-fixed throttle opening, TAT, obtained in step S720, is set to the target throttle opening, TTA, in step S1060, without adjusting the engine load using the target throttle opening, TA.

While step S970 is repeatedly executed in successive cycles of the routine as described above, the engine load is adjusted with the reference throttle opening, TAKGi, set to the target throttle opening, TTA.

While step S1040 is repeatedly executed in successive cycles of the routine, the target throttle opening, TTA, causes the engine load at that time to be adjusted or maintained at a fixed value.

While step S1050 is repeatedly executed in successive cycles of the routine, the reference throttle opening TAKG (i+1) of the (i+1)-th air-fuel ratio calibration region, adjacent to the current calibration region on the side of the larger intake air flow rate, GA, is set to the target throttle opening, TTA, so that the engine load is adjusted.

While step S1060 is repeatedly executed in successive cycles of the routine, the non-fixed throttle opening, TAT, obtained in step S720, namely, the throttle opening corresponding to the required torque, is set to the target throttle opening, TTA (S1060).

Once the above-described operation (S970, S1040, S1050, S1060) for setting the target throttle opening, TTA, is finished, step S1100 is started.

In step S1100, the charging efficiency of the engine 4 (hereinafter called "steady-state charging efficiency") KLTA, that can be taken in a steady state under the conditions of the current engine speed, NE, and throttle opening, TA, is obtained from the map f2, stored in the ROM 50*b*, based on the engine speed, NE, and the throttle opening, TA.

In the next step S1110, the response delay time constant, NSM, of the control of the intake air flow rate with the throttle valve 32, is obtained from the map f3, stored in ROM 50*b*, based on the steady-state charging efficiency, KLTA, and the engine speed, NE. The time constant, NSM, is represented by a positive integer. Step S1120 is then executed to calculate the charging efficiency, KLCRT, at the current point of time, using the time constant, NSM, the above-indicated steady-state charging efficiency, KLTA, and the charging efficiency, KLCRT, obtained in the last cycle, according to the expression (15) as follows.

$$KLCRT=KLCRT+(KLTA-KLCRT)/NSM \quad (15)$$

To calculate the charging efficiency KLVLV (hereinafter called "charging efficiency upon intake valve closing") at the point of time when the intake valve is closed, step S1130 is executed to set the number of times "nfwd" of calculation of the expression (16) as described later to $\Delta T/\Delta t$ (nfwd=$\Delta T/\Delta t$), and clear the value of the variable "ii" set in the RAM 50*c*. Step S1140 is then executed to set the charging efficiency, KLCRT, obtained in step S1120, as the initial value of the charging efficiency, KLVLV, when the intake valve is closed.

Subsequently, the value of the variable "ii" is incremented in step S1150, and a new charging efficiency, KLVLV, upon intake valve closing, is calculated in step S1160, according to the following expression (16).

$$KLVLV=KLVLV+(KLTA-KLVAV)/NSM \quad (16)$$

Next, step S1170 is executed to determine if the value of the variable "ii" coincides with the number of times "nfwd" of calculation.

If the variable "ii" is still smaller than the number of times "nfwd" of calculation ("NO" in step S1170) even with an increment in step S1150, step S1150 through step S1170 are repeated. In this manner, the calculation of the expression (16) is performed as long as "ii" is smaller than "nfwd" ("NO" is obtained in step S1170), to gradually update the charging efficiency KLVLV with intake valve closing, in step S1060.

When the variable "ii" becomes equal to "nfwd" ("YES" in step S1170), step S1200 is executed to obtain the output torque reduction rate RTQ according to the following expression (17).

$$RTQ=KLVLVT/KLVLV \geqq 1.0 \quad (17)$$

Here, "$\geqq 1.0$" at the end of the above expression means the value of "KLVLVT/KLVLV" is set to RTQ if greater than or equal to 1.0, and 1.0 is set to RTQ when the value of "KLVLT/KLVLV" is less than 1.0.

Step S1210 is then executed to calculate the ignition timing, AOP corresponding to the output torque reduction rate, RTQ, according to the expression (18) below. Thus, even when the target throttle opening, TTA, is controlled so that the engine load is adjusted with any one of steps S970, S1040 and S1050 executed, the output torque can be adjusted to a further lower level in accordance with the required torque.

$$AOP=k1(NE, KLVLV, RTQ, VT, AKNK) \quad (18)$$

Here, k1( ) represents a function for obtaining the ignition timing AOP, which function is determined by experiments. AKNK, represents the ignition timing (knock lag amount) calculated under knock control.

Thus, the ignition timing, AOP, with which the output torque is reduced in accordance with the required torque is calculated using the function k1( ), based on the engine speed, NE, charging efficiency, KLVLV, upon intake valve closing, output torque reduction rate, RTQ, valve timing, VT, and the knock lag amount, AKNK.

Step S1220 is then executed to calculate the output torque reduction rate, RTQAOP, that is needed when the output torque cannot be sufficiently reduced with the ignition timing, AOP, according to the expression (19) as follows:

$$RTQAOP=p1\ (AOP, AKNK, NE, VT, KLVLV) \quad (19)$$

where p1( ) represents a function for obtaining the output torque reduction rate, RTQAOP, which function is determined by experiments.

Step S1230 is then executed to calculate the valve timing, VTT, corresponding to the output torque reduction rate, RTQAOP, according to the equation (20) as below. With the adjustment of the valve timing, VTT, as well as the ignition timing, AOP, the output torque can be reduced to the required torque.

$$VTT=k2\ (RTQAOP, RTQ, NE, KLVLV) \quad (20)$$

where k2( ) represents a function for obtaining the valve timing, VTT, which function is determined by experiments.

Step S1240 is then executed to calculate the output torque reduction rate, RTQVTT, that is further needed when the output torque cannot be sufficiently reduced with the ignition timing, AOP, and the valve timing, VTT, according to the expression (21) as follows:

$$RTQVTT=p2\ (VT, VTT, NE, KLVLV) \quad (21)$$

where p2( ) represents a function for obtaining the output torque reduction rate, RTQVTT, which function is determined by experiments.

Step S1250 is then executed to calculate the air-fuel ratio, AAF, corresponding to the output torque reduction rate, RTQVTT, according to the expression (22) as below. Also, by performing control of the air-fuel ratio, AAF, in this step, the output torque is adjusted to a lower level that corresponds to the required torque.

$$AAF=k3(RTQAOP, RTQ, RTQVTT, NE, KLVLV) \quad (22)$$

where k3( ) represents a function for obtaining the air-fuel ratio, AAF, which function is determined by experiments.

Step S1260 is then executed to calculate the output torque reduction rate, RTQAAF, that is further needed when the output torque cannot be sufficiently reduced even with the air-fuel ratio, AAF, according to the expression (23) as follows:

$$RTQAAF=p3\ (AAF, VTT, NE, KLVLV) \quad (23)$$

where p3( ) represents a function for obtaining the output torque reduction rate, RTQAAF, which function is determined by experiments.

Step S1270 is then executed to calculate the control shift position, SHIFT, corresponding to the output torque reduction rate, RTQAAF, according to the expression (24) below. By controlling the change gear ratio in this step, the output torque can be adjusted to a lower level that corresponds to the required torque.

$$SHIFT=k4\ (RTQAAF, RTQAOP, RTQ, RTQVTT, SHIFT0, NE, KLVLV) \quad (24)$$

where k4( ) represents a function for obtaining the control shift position, tSHIFT, which function is determined by experiments, and SHIFT0 represents the current shift position.

In the above manner, the throttle opening control routine is once terminated.

Figure 21:
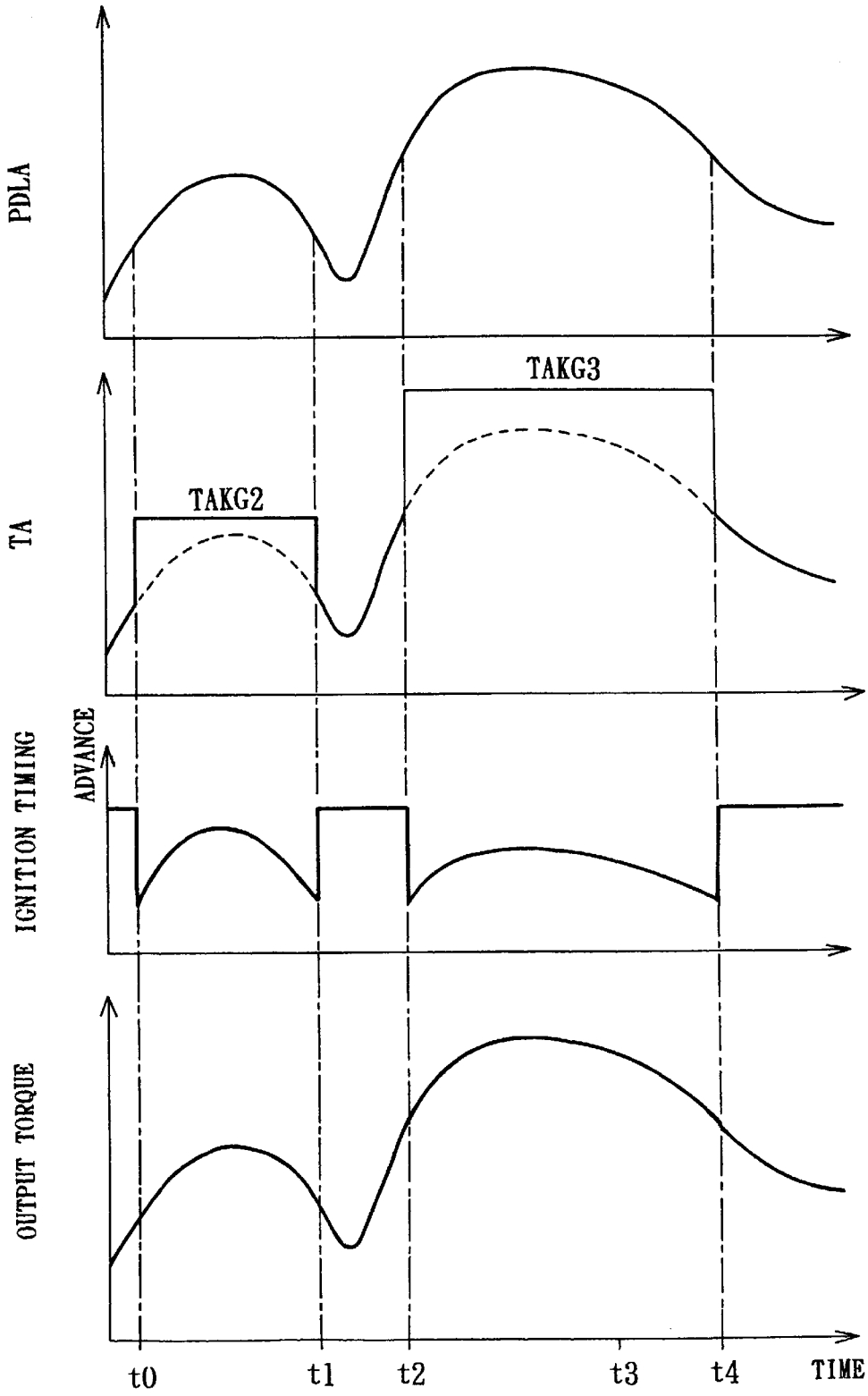
FIG. 21 is a timing chart showing one example of throttle opening control according to the present invention.

FIG. 21 is a timing chart showing one example of control according to the above-described routine. In this example, the air-fuel ratio learning conditions are not satisfied immediately before time t0 ("NO" in step S910), and the non-fixed throttle opening TAT corresponding to the accelerator pedal position PDLA (the degree by which the accelerator pedal is depressed by the driver), namely, the value that depends upon the required torque, is set to the target throttle opening TTA (S1060). Accordingly, the throttle opening, TA, changes in accordance with the accelerator pedal position, PDLA, up to the point of time t0.

The air-fuel ratio learning conditions are satisfied at time t0 ("YES" is obtained in step S910). At this point of time t0, the engine is in the second air-fuel ratio calibration region, and the air-fuel ratio calibration completion flag, XFGAFOK2, is equal to zero ("YES" in step S920).

Suppose the above-indicated expression (13) is satisfied ("YES" in step S930) at this time. Indicating where the engine load is adjusted with the throttle opening, TA, shifted to the reference throttle opening, TAKG2, in the current second air-fuel ratio calibration region, the output torque can be adjusted the output torque with the non-fixed throttle opening, TAT, through adjustment of the ignition timing and other factors. In the example of FIG. 21, the output torque is to be controlled only by adjusting the ignition timing.

In the above case, the reference throttle opening, TAKG2, is set to the target throttle opening, TTA, in step S970. As long as step S970 is repeatedly executed in the same second air-fuel ratio calibration region (during the time between t0 and t1), the throttle opening, TA, of the throttle valve 32 is adjusted to the reference throttle opening, TAKG2, so that the engine load is adjusted, or maintained at a fixed level.

With air-fuel ratio calibration in the second air-fuel ratio calibration region is completed at the point of time t1, the air-fuel ratio calibration completion flag, XFGAFOK2, becomes equal to 1 ("NO" in step S920). Since "i" is equal to 2, an affirmative decision "YES" is obtained in step S940. If the air-fuel ratio calibration completion flag, XFGAFOK3, for the third air-fuel ratio calibration region is equal to zero ("YES" in step S950), step S960 is executed to determine if the above-indicated expression (14) is satisfied.

Specifically, step S960 determines if the output torque can be adjusted to the output torque obtained with the non-fixed throttle opening, TAT, through adjustment of the ignition timing, where the engine load is adjusted with the throttle opening shifted to the reference throttle opening, TAKG3, of the third air-fuel ratio calibration region.

If TAT is less than TAKGLOW3, and the relationship of the expression (14) is not satisfied ("NO" in step S960), the control flow goes to step S980. A negative decision "NO" is obtained in step S980 if the purge concentration calibration conditions are not satisfied. In this case, step S1060 is executed, and the non-fixed throttle opening, TAT, corresponding to the accelerator pedal position, PDLA, established by the driver is set to the target throttle opening (during the time between "t1" and "t2"). Indicating the throttle opening, TA, returns to the state in which it changes in accordance with the accelerator pedal position, PDLA.

Subsequently, the engine enters the third air-fuel ratio calibration region at a point of time t2. If the air-fuel ratio calibration completion flag, XFGAFOK3, for the third air-fuel ratio calibration region is equal to zero ("YES" in step S920), step S930 determines whether the relationship of the expression (13) is satisfied.

Suppose that the output torque can be adjusted to be equivalent to the output torque provided with the non-fixed throttle opening, TAT, by adjusting the ignition timing, where the engine load adjusted with the throttle opening shifted to the reference throttle opening, TAKG3, in the current third air-fuel ratio calibration region ("YES" in step S930). In this case, step S970 is executed to adjust the engine load by controlling the throttle opening, TA, to the reference throttle opening TAKG3, to maintain a constant engine load (during the time between t2 and t3).

When the air-fuel ratio calibration in the third air-fuel ratio calibration region is completed at a point of time t3, the air-fuel ratio calibration completion flag, XFGAFOK3 is set to 1 ("NO" in step S920). Since "i" is equal to 3, an affirmative decision "YES" is obtained in step S940. If the air-fuel ratio calibration completion flag, XFGAFOK4, for the fourth air-fuel ratio calibration region is equal to zero ("YES" in step S950), it is determined if the relationship of the expression (14) is satisfied or not in step S960.

Specifically, step S960 determines if the output torque can be adjusted to be equivalent to the output torque obtained with the non-fixed throttle opening, TAT, by adjusting the ignition timing, where the engine load is fixed with the throttle opening shifted to the reference throttle opening, TAKG4, of the fourth air-fuel ratio calibration region.

If TAT is less than TAKGLOW4, and expression (14) is not satisfied ("NO" in step S960), the control flow goes to step S980. If the purge concentration calibration conditions are satisfied ("YES" is obtained in step S980), S990 is executed to determine if the purge concentration learning completion flag, XFGPGOK, is equal to zero.

If XFGPGOK is equal to zero ("YES" is obtained in step S990), step S1000 is executed to determine if the relationship (13) is satisfied or not. If the relationship (13) is satisfied ("YES" in step S1000), step S970 is executed so that the engine load is kept adjusted for an extended period of time (between t3 and t4) such that the throttle opening, TA,is controlled to the reference throttle opening, TAKG3.

When the purge concentration calibration is completed at a point of time t4, and the purge concentration calibration completion flag, XFGPGOK, is set to 1 ("NO" in step S990), step S1060 is executed, and the throttle opening, TA, returns to the state in which it changes in accordance with the accelerator pedal position, PDLA, indicating the throttle opening, TA, changes in proportion to the accelerator pedal position, PDLA, after the point of time t4.

Thus, even if the engine load (intake air flow rate GA) is set to be high and fixed at that level, the output torque can be adjusted in accordance with the required torque, by performing a lag operation on the ignition timing.

Figure 22:
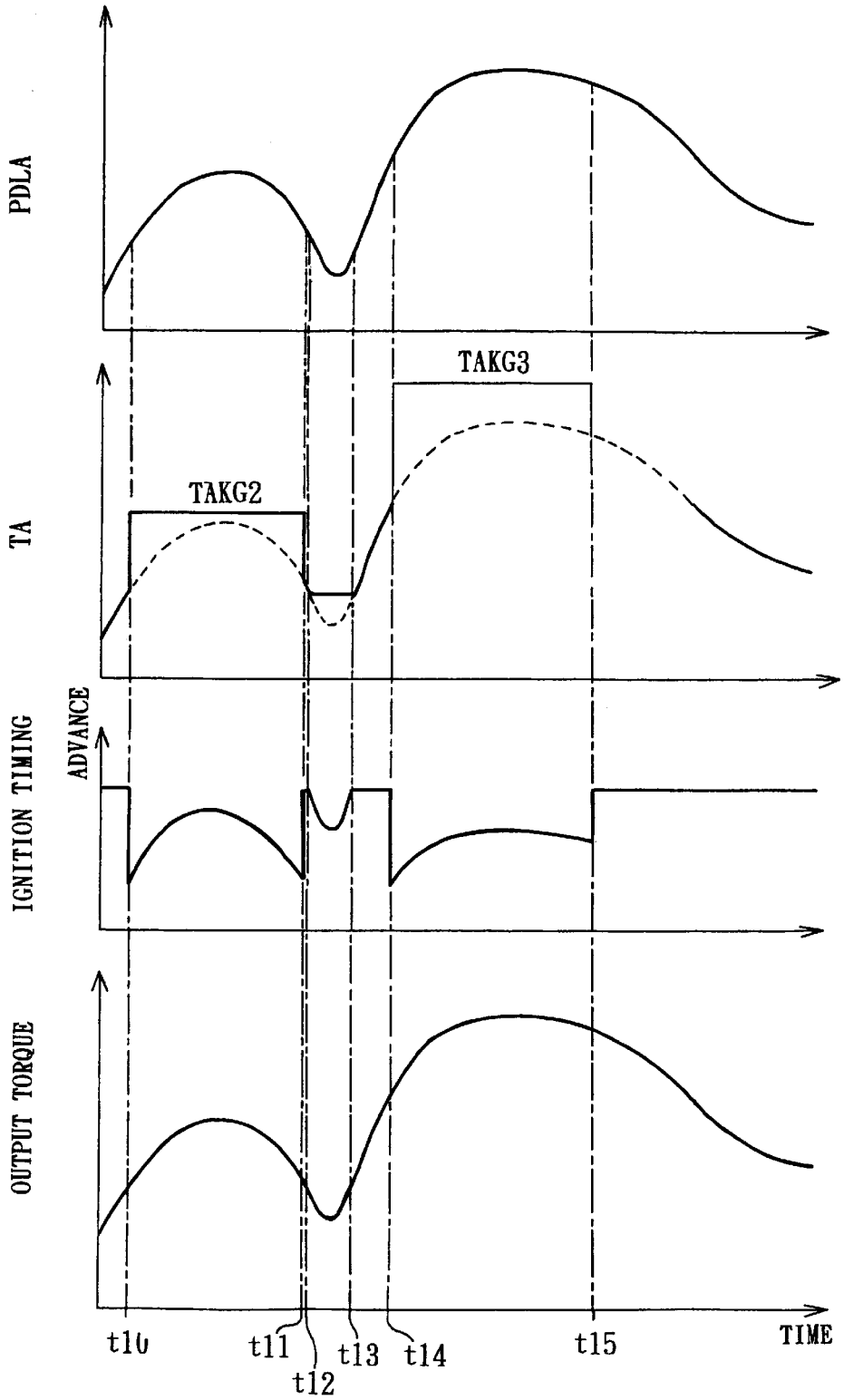
FIG. 22 is a timing chart showing another example of throttle opening control of the present invention.

FIG. 22 is a timing chart showing a second example of the throttle opening control. The engine is in the same operating state before time t11 as similarly indicated before time t1 in FIG. 21.

If the air-fuel ratio calibration in the second air-fuel ratio calibration region is completed at time t11, the air-fuel ratio calibration completion flag, XFGAFOK2, is set to 1 ("NO" in step S920). Since "i" is equal to 2, an affirmative decision "YES" is obtained in step S940. If the air-fuel ratio calibration completion flag, XFGAFOF3, for the third air-fuel ratio calibration region is equal to zero ("YES" in step S950), S960 is executed to determined if the above-indicated relationship of the expression (14) is satisfied. If TAT is less than TAKGLOW3, and the relationship (14) is not satisfied ("NO" in step S960), the control flow goes to step S980.

If step S980 determines that the purge concentration calibration conditions are not satisfied ("NO" in step S980), the non-fixed throttle opening TAT that depends upon the accelerator pedal position, PDLA (degree of depression of the accelerator pedal by the driver) is set to the target throttle opening, TTA, in step S1060. Accordingly, the throttle opening, TA, returns to the state in accordance with the accelerator pedal position, PDLA, during the period between time t1 and time t2.

If the purge concentration calibration conditions are satisfied at time t12 ("YES" in step S980), S990 is then executed to determine if the purge concentration calibration completion flag, XFGPGOK, is equal to zero.

If XFGPGOK is equal to zero ("YES" is obtained in step S990), step S1000 is executed to determine if the relationship of the above-indicated expression (13) is satisfied. If the relationship (13) is not satisfied ("NO" instep S1000), step S1010 is executed to determine if the relationship (14) is satisfied. If the relationship (14) is also not satisfied ("NO" in step S1010), step S1020 is executed to determine if the non-fixed throttle opening, TAT, set in step S720 is less than the target throttle opening TTA0, in the last cycle.

If TTA0 is smaller than TAT ("YES" in step S1020), the ratio (KLTA/KLTAT) of the steady-state charging efficiency, KLTA, based on the throttle opening, TA, detected by the throttle sensor 36, to the non-fixed steady-state charging efficiency, KLTAT, obtained in step S730, is calculated, and if the ratio is less than the reference value, KS, is determined in step S1030.

If KLTA/KLTAT is less than KS ("YES" is obtained in S1030), indicating the required torque does not drop or decrease by a large degree, the value of the target throttle opening, TTA0, in the last cycle is set to the target throttle opening, TTA, in step S1040. Thus, the target throttle opening, TTA, is maintained at the current value, and the engine load is adjusted. Specifically, the throttle opening, TA, is controlled so that the engine load at that time is maintained (during the period between time t12 and time t13). During this period (between t12 and t13), the ignition timing is controlled so that the output torque is adjusted in accordance with the required torque.

If the purge concentration calibration conditions are not satisfied at time t13 ("NO" in step S980), or if the purge concentration calibration is completed and the flag XFGPGOK is set to 1 ("NO" in step S990), the non-fixed throttle opening, TAT, corresponding to the accelerator pedal position, PDLA, established by the driver is set to the target throttle opening, TTA, in step S1060. Accordingly, the throttle opening, TA, returns to the state in which it changes in accordance with changes in the accelerator pedal position, PDLA (during the period between time t13 and time t14).

Suppose that during the period between t13 and t14, the engine shifts from the second air-fuel ratio calibration region to the third air-fuel ratio calibration region, that the air-fuel ratio calibration conditions are satisfied ("YES" in step S910), that the airfuel ratio calibration completion flag, XFGAFOK3, is equal to zero ("YES" in step S920), and that the relationship (13) is satisfied ("YES" in step S930).

In this case, step S970 is executed to set the reference throttle opening, TAKG3, to the throttle opening, TA, so that the engine load is adjusted and maintained at a constant level (during the period between time t4 and time t5).

If the air-fuel ratio calibration in the third air-fuel ratio calibration region is completed at time t5, the air-fuel ratio calibration completion flag, XFGAFOK3, is set to 1 ("NO" in step S920). Since "i" is equal to 3, an affirmative decision "YES" is obtained in step S940. If the air-fuel ratio calibration completion flag XFGAFOK4 for the fourth air-fuel ratio calibration region is equal to zero ("YES" in step S950), step S960 is executed to determine if the relationship (14) is satisfied.

If TAT is less than TAKGLOW4, and the expression (14) is not satisfied ("NO" in step S960), the control flow goes to step S980. If the purge concentration calibration conditions are satisfied ("YES" in step S980), step S990 is executed to determine if the purge concentration calibration completion flag, XFGPGOK, is equal to zero or not.

If the flag XFGPGOK is already equal to 1 ("NO" in step S990), the non-fixed throttle opening, TAT, that depends upon the accelerator pedal position, PDLA, established by the driver is set to the target throttle opening, TTA (S1060). Accordingly, the throttle opening, TA, returns to the state in which it changes in accordance with changes in the accelerator pedal position, PDLA, after the point of time t15.

Thus, even if the engine load (the intake air flow rate GA) is set to be high and fixed at that level, the output torque can be adjusted in accordance with the required torque, utilizing a lag operation of the ignition timing.

With the arrangement of the first embodiment as described above, the load of the internal combustion engine is fixed by executing steps S910 through S970 and S1050. Then, the output torque of the engine is controlled by executing steps S1200 through S1270. With the routines of FIG. 9 to FIG. 11, the fuel that evaporates from the fuel tank of the engine is purged into the intake pipe. During purging, the routine of FIG. 6 is executed so as to calibrate the purge concentration calibration value from the behavior or variations of the air-fuel ratio feedback correction value. Also, during the purge concentration calibration, steps S990 through S1060 and S970 are executed to adjust the load of the engine. Furthermore, while the engine load is being adjusted, the output torque of the engine is controlled by adjusting factors of changes or variations in the output torque of the engine other than the engine load, in accordance with the required torque (in steps S1200 through S1270).

In the first embodiment as explained above, when the air-fuel ratio calibration value, KGj, is obtained by calibration the air-fuel ratio feedback correction factor, FAF, (FIG. 4 and FIG. 5), the engine load (the intake air flow rate GA in this embodiment) is adjusted by the operations of steps S970 and S1050. Even where the driver operates the accelerator pedal 38 so as to change the required torque, the engine load does not change, and the air-fuel ratio of the air-fuel mixture is stabilized. Accordingly, calibration of the air-fuel ratio feedback correction factor, FAF, can be promptly accomplished with high accuracy.

Thus, highly accurate calibration of the air-fuel ratio feedback correction factor, FAF, can be completed in a short time, thus avoiding adverse influences on the quality of the emissions.

Furthermore, while the engine load is being adjusted, the output torque of the engine 4 can be controlled in accordance with the required torque, by adjusting an output torque variation factor or factors (at least one of the ignition timing, valve timing, air-fuel ratio and shift position in this embodiment), other than the engine load (S1200 through S1270).

Thus, the output torque of the engine 4 reflects the required torque even while the air-fuel ratio feedback correction factor, FAF, is calibrated with the engine load being fixed.

Since a plurality of output torque variation factors, other than the engine load, are combined for use in control in the illustrated embodiment, the output torque of the engine 4 can be adjusted over an even wider range.

Where the output torque cannot be controlled to sufficiently reflect the required torque by adjusting the output torque variation factor(s), other than the engine load, indicating, when "NO" is obtained in step S980 or "NO" is obtained in step S960, the engine load ceases to be fixed (S1060). This prevents the situation in which the required torque cannot be fully indicated by the actual output torque of the engine. It is thus possible to ensure an output torque that is equivalent to the required torque, without deteriorating the performance of the engine 4.

The intake air flow rate, GA, is fixed to a reference position in one of a plurality of air-fuel ratio calibration regions. With the intake air flow rate, GA, always set to a fixed value for each calibration region, the air-fuel ratio feedback correction factor, FAF, can be calibrated with further enhanced accuracy.

In particular, the reference position as described above is located at the center of each calibration region. Therefore, the engine load fixed to the reference position can be made most appropriate to represent the relevant air-fuel ratio calibration region, thus assuring even further improved accuracy during calibration.

In the illustrated embodiment, a vaporized fuel purge system is provided, and the control routine of FIG. 9 through FIG. 11 is executed for purging vaporized fuel from the fuel tank 31 into the surge tank 18. In the vaporized fuel purge system, purging needs to be started in an early stage after the start of the engine 4, so as to prevent the canister 98 from being saturated.

The purging is started provided that calibration of the air-fuel ratio feedback correction factor, FAF, is completed. In the present embodiment, calibration of the air-fuel ratio feedback correction factor, FAF, can be promptly completed, as described above. Accordingly, purging of the vaporized fuel can be started in an early stage of the engine operation, and the canister 98 is less likely to be saturated, thus more effectively preventing the vaporized fuel from leaking into the ambient air.

In order to accurately control the air-fuel ratio where the vaporized fuel purge system is provided, it is necessary to promptly calibrate the concentration of the vaporized fuel to be purged, and reflect the result by air-fuel ratio control in its early stage.

To enable accurate calibration of purge concentration, accurate calibration of the air-fuel ratio feedback correction factor, FAF, needs to have been completed. In the present embodiment, calibration of the air-fuel ratio feedback correction factor, FAF, can be performed with high accuracy, and also completed in a short time.

Accordingly, the air-fuel ratio can be accurately controlled even with the vaporized fuel purge system.

During calibration of the purge concentration, the engine load is fixed by the operations of steps S980 through S1050 and S970. In this case, the engine load does not change, and the air-fuel ratio of the air-fuel mixture is stabilized, so that the purge concentration calibration can be performed with high accuracy, and completed in a short time.

The above arrangement makes it possible to further effectively prevent adverse influences on the emissions.

Where the engine load is adjusted during purge concentration learning, the output torque of the engine 4 is controlled in accordance with the required torque, by adjusting an output torque variation factor or factors (at least one of the ignition timing, valve timing, air-fuel ratio and shift position in this embodiment), other than the engine load, by the operations of steps S1200 through S1270. Accordingly, the required torque can be sufficiently balanced by the actual output torque even if the purge concentration calibration is performed with the engine load being fixed.

Since a plurality of output torque variation factors, other than the engine load, are combined for use in control, the output torque of the engine 4 can be adjusted over an even wider range.

Where the output torque of the engine cannot be controlled to sufficiently reflect the required torque by adjusting the output torque variation factor(s) other than the engine load while the purge concentration calibration is performed with the engine load fixed ("NO" in step S1000, "NO" in step S1010, and "NO" in step S1020 or step S1030), the engine load ceases to be fixed, namely, the control for fixing the engine load is cancelled (S1060). This prevents the situation in which the required torque cannot be sufficiently reflected by the output torque. It is therefore possible to ensure an output torque that is equivalent to the required torque, without deteriorating the performance of the engine 4.

The intake air flow rate, GA, is fixed to a reference position in one of a plurality of air-fuel ratio calibration regions provided for air-fuel ratio feedback correction factor calibration (S970, S1050). With the intake air flow rate, GA, always set to a fixed value for each calibration region, the purge concentration value is calibrated only after completion of accurate calibration of the air-fuel ratio feedback correction factor, FAF. Accordingly, the purge concentration calibration value can be obtained with further enhanced accuracy.

In particular, the reference position as indicated above is located at the center of each calibration region. With this arrangement, the engine load fixed to the reference position can be made most appropriate to represent the relevant air-fuel ratio calibration region, thus assuring even further improved accuracy in purge concentration calibration.

In the illustrated embodiment, while the engine load is being adjusted, the output torque is controlled in accordance with the required toque, by adjusting one or more of the ignition timing, valve timing, air-fuel ratio and the shift position. It is, however, possible to use any one of these output torque variation factors. In particular, the ignition timing is preferably used so that the output torque can reflect the required torque with good response.

In the illustrated embodiment, if the average value, FAFAV, of the air-fuel ratio correction factor, FAF, falls within the range of 1.02 to 0.98, at least once, the air-fuel ratio calibration completion flag, XFGAFOKj, is set, and calibration of the air-fuel ratio feedback correction factor, FAF, is completed. In a modified example, the air-fuel ratio calibration completion flag, XFGAFOKj, may be set for the first time when the average value, FAFAV, falls within the range of 1.02 to 0.98 a certain number of times.

In the illustrated embodiment, the electronic control unit (ECU 50) is implemented as a programmed general purpose computer. It will be appreciated by those skilled in the art that the controller can be implemented using a single special purpose integrated circuit (e.g., ASIC) having a main or central processor section for overall, system-level control, and separate sections dedicated to performing various different specific computations, functions and other processes under control of the central processor section. The controller also can be a plurality of separate dedicated or programmable integrated or other electronic circuits or devices (e.g., hardwired electronic or logic circuits such as discrete element circuits, or programmable logic devices such as PLDs, PLAs, PALs or the like). The controller can be implemented using a suitably programmed general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the flowcharts shown in FIGS. 3–11 and 15–20, can be used as the controller. A distributed architecture can be used for a maximum total signal processing and speed.

While the engine load is immediately shifted to the reference position of the current air-fuel ratio calibration region when the engine load is fixed to the reference position, the engine load may be shifted in steps to the reference position. This leads to further reduction in fluctuation of the air-fuel ratio, assuring even higher accuracy in calibration.

What is claimed is:

1. An air-fuel ratio control apparatus, comprising:

a detector that detects an air-fuel ratio of an air-fuel mixture supplied to an internal combustion engine; and an engine control system that:

determines an air-fuel ratio feedback correction value based on the air-fuel ratio;

determines an air-fuel ratio calibration value based on behavior of the air-fuel ratio feedback correction value;

controls a fuel concentration of the air-fuel mixture in a feedback manner, based on the air-fuel ratio feedback correction value and thee air-fuel ratio calibration value; and adjusts a load of the engine when calibrating the air-fuel ratio calibration value.

2. An apparatus according to claim 1, wherein the control system adjusts an output torque of the engine in accordance with a required torque when the control system adjusts the load of the engine.

3. An apparatus according to claim 2, wherein the control system adjusts the output torque by adjusting at least one of ignition timing, valve timing, change gear ratio, and the air-fuel ratio.

4. An apparatus according to claim 2, wherein the control system stops adjusting the load of the engine when a difference between the output torque and the required torque of the engine is greater than or equal to a predetermined value.

5. An apparatus according to claim 1, wherein the control system establishes a plurality of calibration regions corresponding to different ranges of the load of the engine, and determines the air-fuel ratio calibration value for each of the calibration regions.

6. An apparatus according to claim 5, wherein the control system adjusts the load of the engine to a reference position within one of the plurality of calibration regions when the control system determines the air-fuel ratio calibration value.

7. An apparatus according to claim 6, wherein the reference position is located at a center of the plurality of calibration regions.

8. An apparatus according to claim 1, wherein the control system purges fuel that vaporizes from a fuel tank of the engine, into an intake pipe.

9. An apparatus according to claim 8, wherein the control system senses a purge concentration calibration value from the behavior of the air-fuel ratio feedback correction value while purging is conducted, and adjusts the load of the engine when determining the purge concentration calibration value.

10. An apparatus according to claim 9, wherein the control system adjusts an output torque of the engine in accordance with a required torque when the control system adjusts the load of the engine.

11. An apparatus according to claim 10, wherein the control system adjusts the output torque by adjusting at least one of ignition timing, valve timing, change gear ratio, and the air-fuel ratio.

12. An apparatus according to claim 10, wherein the control system stops adjusting the load of the engine when a difference between the output torque and the required torque of the engine is greater than or equal to a predetermined value.

13. An apparatus according to claim 9, wherein the control system establishes a plurality of calibration regions corresponding to different ranges of the load of the engine, and calibrates the purge concentration calibration value for each calibration region, and wherein the control system adjusts the load of the engine to a reference position within one of the plurality of calibration regions when the control system senses the purge concentration calibration value.

14. An apparatus according to claim 13, wherein the reference position is located at the center of the plurality of calibration regions.

15. A control method for use with an internal combustion engine in which an air-fuel ratio of an air-fuel mixture supplied to the engine is based upon the engine load, the method comprising:

determining an air-fuel ratio feedback correction value based on the air-fuel ratio;

determining an air-fuel ratio calibration value based upon behavior of the air-fuel ratio feedback correction value;

determining a fuel concentration of the air-fuel mixture in a feedback manner, based on the air-fuel ratio feedback correction value and the air-fuel ratio calibration value; and adjusting a load of the engine when determining the air-fuel ratio calibration value.

16. A method according to claim 15, wherein the adjusting step adjusts an output torque of the engine in accordance with a required torque when the load of the engine is adjusted.

17. A method according to claim 16, wherein the adjusting step adjusts the output torque by adjusting at least one of ignition timing, valve timing, change gear ratio, and the air-fuel ratio.

18. A method according to claim 16, wherein the adjusting step stops adjusting the load of the engine when a difference between the output torque and the required torque of the engine is greater than or equal to a predetermined value.

19. A method according to claim 15, wherein a plurality of calibration regions corresponding to different ranges of the load of the engine are established, and the air-fuel ratio calibration value is determined for each of the calibration regions.

20. A method according to claim 19, wherein the adjusting step adjusts the load of the engine to a reference position within one of the plurality of calibration regions, when the air-fuel ratio calibration value is determined.

21. A method according to claim 20, wherein the reference position is located at a center of the plurality of calibration regions.

22. A method according to claim 15, wherein the adjusting step purges fuel that vaporizes from a fuel tank of the engine, into an intake pipe.

23. A method according to claim 22, wherein the air-fuel ratio calibration value determining step senses a purge concentration calibration value from the behavior of the air-fuel ratio feedback correction value while purging is conducted, and the adjusting step adjusts the load of the engine when the purge concentration calibration value is determined.

24. A method according to claim 23, wherein the adjusting step adjusts an output torque of the engine in accordance with a required torque.

25. A method according to claim 24, wherein the adjusting step adjusts the output torque by adjusting at least one of ignition timing, valve timing, change gear ratio, and the air-fuel ratio.

26. A method according to claim 24, wherein the adjusting step stops adjusting the load of the engine when a difference between the output torque and the required torque of the engine is greater than or equal to a predetermined value.

* * * * *